United States Patent [19]

Schoch

[11] Patent Number: 4,939,918

[45] Date of Patent: Jul. 10, 1990

[54] MONITORABLE AND COMPENSATABLE FEEDBACK TOOL AND CONTROL SYSTEM FOR A PRESS

[75] Inventor: Daniel A. Schoch, Minster, Ohio

[73] Assignee: The Minster Machine Company, Minster, Ohio

[21] Appl. No.: 90,215

[22] Filed: Aug. 27, 1987

[51] Int. Cl.[5] ..... B30B 15/00; B21D 22/00

[52] U.S. Cl. ..... 72/20; 72/453.13

[58] Field of Search ..... 72/1, 19, 20, 21, 37, 72/12, 453.13; 267/119, 130

[56] References Cited

U.S. PATENT DOCUMENTS

| | | | |
|---|---|---|---|
| 3,914,975 | 10/1975 | Kawano | 72/453.13 X |
| 4,308,735 | 1/1982 | Nishi | 72/21 |
| 4,592,220 | 6/1986 | Martinez et al. | 72/19 X |
| 4,599,887 | 7/1986 | Asai et al. | 72/453.13 |
| 4,635,466 | 1/1987 | Seki et al. | 72/453.13 |
| 4,667,496 | 5/1987 | Asai et al. | 72/20 |
| 4,698,991 | 10/1987 | Kirii et al. | 72/21 |

FOREIGN PATENT DOCUMENTS

| | | | |
|---|---|---|---|
| 0059432 | 9/1982 | European Pat. Off. | 72/453.13 |
| 2247201 | 3/1973 | Fed. Rep. of Germany . | |
| 2324839 | 12/1973 | Fed. Rep. of Germany . | |
| 2915966 | 11/1980 | Fed. Rep. of Germany . | |
| 3502803 | 7/1986 | Fed. Rep. of Germany . | |
| 3530204 | 10/1986 | Fed. Rep. of Germany . | |
| 227058 | 9/1985 | German Democratic Rep. | 72/453.13 |
| 227349 | 9/1985 | German Democratic Rep. | 72/453.13 |
| 846044 | 7/1981 | U.S.S.R. | 72/453.13 |
| 1011296 | 4/1983 | U.S.S.R. | 72/34 |

*Primary Examiner*—E. Michael Combs

*Attorney, Agent, or Firm*—Jeffers, Hoffman & Niewyk

[57] ABSTRACT

A load control system and tool arrangements are disclosed for controlling the shutheight and back-up load on a mechanical press tool in response to a monitored or measured parameter indicative of press tool force or part quality, which monitored parameter is communicated to a controller for determination of a control signal to control a means for regulating the press tool back-up load and shutheight without interrupting press operations. The control system is operable to control a single station or multi station press and can be installed on either an individual press tool or the bolster or slide.

30 Claims, 12 Drawing Sheets

MONITORABLE AND COMPENSATABLE FEEDBACK TOOL AND CONTROL SYSTEM FOR A PRESS

BACKGROUND OF THE INVENTION

The present invention relates to mechanical presses, and in particular to a monitorable, feedback controllable tool system for the dies and tool sets of the presses. More specifically, the tool and control system are operable and adaptable to dynamically adjust a single tool, the complete die set or the individual tool station of a multi-station die set to maintain the dimensional tolerances and thus the quality of the parts produced on the press.

Mechanical presses, such as straight side presses and gap frame presses for stamping and drawing, generally comprise a frame having a crown, a bed and a slide supported within the frame for reciprocal motion toward and away from the bed. The slide may be driven by a crankshaft and a connecting arm connected to the slide, to which is mounted the upper die. The lower die is mounted on a bolster connected to the bed. Alternatively, the upper die can be stationary and the reciprocating slide, to which the lower tooling is connected, mounted beneath the upper die. Mechanical presses are widely used for blanking and drawing operations, and vary substantially in size and available tonnage depending upon the intended use. The present invention is particularly well suited to a conversion press for forming easy open beverage can ends where precise control of dimensional tolerances of certain operations, such as embossing and scoring, is critical. This precision dimensional control is required without using the excess tonnage (force) currently provided with the use of oversize kiss blocks in the tooling.

Many presses are operable with single or multiple tooling stations and this tooling or the part formed therefrom may vary during operation either from tool wear, temperature changes, or stock material variations. These variations or changes in parameters may cause distortions and/or dimensional variations in the parts produced or formed on the presses. Therefore, it is necessary to continuously monitor the parts produced and to alter or adjust the tooling and press to maintain production of acceptable or quality parts. This quality control function frequently necessitates removal of the dies or tools or some components thereof from the press and subsequent readjustment of the press for production of quality parts. Current industry practice is to provide the readjustments with the press in a static or non running condition, which may not incorporate the thermal and/or speed effects into the adjustment.

Presses, both the mechanical and hydraulic type, have been provided with various arrangements to attempt to accommodate variations in parameters associated with press operations. Included among these adjusting arrangements are die cushions, wherein a hydraulic fluid behind the tooling or die, generally the lower die arrangement, provides a hydraulic cushion. Other efforts at tool control included mechanically operated hydraulic systems, and hydraulic overload control systems, which accommodate or are operable to a maximum load exerted upon the die by the slide during the work stroke. The overload control systems only provide a means to stop the press in case of an overload.

Adjustment means for the press or tools have been devised to be responsive or operable as a function of the stroke frequency. In some cases the adjustments were based upon constant immersion depth of the upper tooling and its adjustment during press operation. Shutheight adjustment by an electrical motor drive has been provided by sensing the shutheight on the fly, stopping the press and adjusting the slide in response to the monitored shutheight. However, the initial shutheight had to be known for comparison. Also known is adjustment of the shutheight provided by adjusting a hydraulic bolster control system, which adjusts the bolster, and consequently all tool stations simultaneously to a fixed height to thus adjust the shutheight.

A known lower tool control system utilizes mechanical springs for controlling the pressure on the work piece. However, no monitoring circuit is known for continuously testing the tooling load, comparing the tooling load to an optimum tool load, providing a feedback signal based on this comparison and adjusting individual tools to the optimal tool load. One instance of an attempt to control a forming force for a tool was provided in the case of a roll forming operation, where a controller-force detector is connected for determining the force exerted on a forming roller. The detector utilizes a contact arm for determining the position of the lower slide and through a look-up table compares force versus position relationships for control of the forming roll. This tool position is then compared to known force/position values for adjustment of the tooling in response to this change.

One prior art technique for tool or die adjustment varied the hydraulic pressure of a hydraulically supported, drop away bolster, which adjustment modified the back-up force and, consequently, the bolster component elongation and the operating shutheight of the press. The bolster used is described in U.S. Pat. No. 4,206,699. However, modifying the bolster pressure in this manner increases the force on the entire bolster and changes the shutheight, but in the case of multiple die station presses, the shutheight is changed for all stations, whether needed or not. Furthermore, this system is not automatic in that it relies on an inspection or monitoring of the produced parts and then manual adjustment of the press.

Historically press tooling has generally been set up or assembled by a trial and error type method. That is, the tooling would be installed in the press or, alternatively, a die was set up externally to the press and positioned in the press and the initial parts produced by the press and tool arrangement are tested or checked to determine if they are in the specification limits. The tooling and/or press are then manually adjusted to produce an acceptable part. The adjustments could be in the form of shutheight variation; shimming of the tools; in the case of multiple lane, progressive die arrangements, shimming of individual tooling stations in the die, or shimming the die set; and grinding of tools or a combination of such adjustments.

In a multiple lane progressive die arrangement, such as in a conversion press, the variation of a single tool station usually influences the remaining stations within a lane of the tool arrangement and, in fact, may influence the other lane or lanes by affecting the tipping moment within the die arrangement. Accordingly, the adjustment of the tooling to bring the operation at one of the die stations into specification limits may cause the other die stations to go out of specification.

In the lead frame press industry, the initial shutheight can be adjusted or zeroed and thereafter varied to attain the upper or lower limit of an acceptable or quality part. The selection of an initial setting may be determined by past operating practices and set to accommodate known variations based upon the above variable parameters including press speed (rpm or frequency) and thermal effects on operating shutheight. Further, changes in the part quality can, as noted earlier, vary with changes in the stock material dimensions from specifications. Variation in stock material thickness or hardness influences quality part production from a press or forming arrangement and affects the required forming load and press operation. Although stock variation is not a change in the press or tooling, it must be accommodated to maintain part production within specification limits.

Accommodation of the variations in tooling and/or press parameters while maintaining acceptable or quality part production has led to the practice of utilizing "kiss blocks", particularly in the can conversion industry for multi-lane progressive die arrangements. The kiss block is a massive positive stop block with a compressive resistance or stiffness greater than the stiffness of the press and is used to limit slide travel. The kiss block can be a single block or multiple blocks generally mounted within the tool area between the slide and bolster with a significant cross-sectional area. The kiss blocks thus define the minimum separation at bottom dead center between the upper and lower dies. Therefore, even if the press is sped up or there is a change in the thermal equilibrium, which generally causes elongation or thermal expansion of the mechanical connections and thus less separation between the tools than in their unrestrained state, the kiss blocks limit further shutheight change of the press. However, the use of oversized kiss blocks to limit the travel of the slide can produce very severe stresses and loads on the press. Typically in the conversion industry, when it is determined that the score line depth is insufficient, the load on the press is increased by decreasing the operating shutheight, but limiting the travel of the upper tooling through the use of kiss blocks. The press experiences a mechanical over-travel condition, however, the tools will continue to travel only to the limit of the kiss block, which maintains the part dimensional specifications. This practice puts a severe strain upon the press frame, and results in an excess work function by the press, which work or energy is not applied to nor required for formation of the stock material to its finished shape. Therefore, this practice results in lower press life; more frequent press breakdowns, which implies less press reliability; and, in addition, requires excess energy not applied to product formation.

Indicative of the above problems is that condition which is found in the can-end industry, particularly for the production of ecologically acceptable can ends or can ends with tear tabs. The press arrangements are generally multi lane, multi station arrangements that are subject to very close tolerances and high volume production rates. Thus it can be appreciated that these high volume rates require high-speed press operation, which results in relatively high or elevated temperature on the tool and press elements. The stock material is relatively thin but will vary in thickness and/or hardness during the production run. High rate press operation results in tool wear, which may result from erosion, jamming at a particular tool station or any other condition which changes the profile and dimension of the tool. These end conversion tools are typically reset on an individual tool station basis, whereas progressive dies are typically removed from the press and reground as a unit. The problem with replacing only one worn tool is that the remaining tools will also have experienced wear. Replacement of a worn or broken tool with a new tool, therefore, can disrupt or disturb the load balance in the die set, causing a potential loss of overall part quality and production.

SUMMARY OF THE INVENTION

Therefore, it has been found that a tool control arrangement which allows adjustment of the tools, either as a group or individually, without their removal or stoppage of the press operation, and accommodates changes in the shutheight would minimize down time, assist in reducing the setup time, reduce excess press load and thus ensure quality part production during continuous press operation. This goal is enhanced by a system which continuously monitors tool performance to maintain the optimal back-up load or operating shutheight without stopping the press.

The present invention, in one form thereof, overcomes the disadvantages inherent in the prior art by providing a tooling arrangement and control circuit for continuous tool load adjustment of press tooling in response to a continuously measured or monitored parameter, such as line pressure or tool load, during operation of the press. The sensed or monitored parameter is communicated to a calibrated display device and controller, which is operable to provide a control signal to adjust the back-up force on the tooling or the individual tool station shutheight. A constant load device is responsive to the fluid pressure and operable to maintain a constant load on the tooling. The constant load or pressure is dynamically controllable, either manually or automatically, based upon a sensed signal indicative of the tooling load or dimensional part measurement. The tooling is adjustable, either by the constant load device or manually, to maintain the load or shutheight at the optimal value.

Continuous monitoring of any parameter related to the tooling load provides a means of monitoring the quality of parts produced on the press. The tool force or load may be correlated to the part quality or specifications initially produced from the tooling, which calibrated force may be from empirical data or calculated from known parameters. Monitoring and dynamic adjustment of tooling load or related parameters during operation of the press provides quality part production without press stoppage or operator intervention.

In one form of the invention, the lower tooling is supported against the force of the movable and/or adjustable tooling by fluid pressure acting against a piston or cylinder connected to the lower tooling. The fluid pressure may be provided by pressurized air or a nitrogen cylinder, and the pressure acting against the lower tooling is maintained very accurately at an optimal level. This ensures that the amount of force exerted on the part during forming will remain constant, even if the shutheight of the press should increase or decrease due to changes in press speed, thermal expansion, etc. For example, even if the press shutheight should decrease, which would typically result in higher tonnage being exerted on the part in fixed, rigid tooling, the back-up force on the lower tooling will remain constant so that the effective tonnage applied to the part will not change. In one of the preferred forms of the invention, a comparator or microprocessor monitors the pressure related to the back-up force and continually compares the force with a reference value of desired or optimal back-up force. The output of the comparator then controls a pressure regulator which maintains the back-up pressure of the fluid precisely at the optimally required reference level. Furthermore, the reference pressure or back-up force level set into the microprocessor or comparator can be varied depending on measurements obtained from monitoring part quality as the press operates. For example, the score residual on an easy open can end in a conversion press can be manually or automatically measured, and the back-up force parameter appropriately increased or decreased as the scoring penetration decreases and increases, respectively. The amount of back-up force on the tool can be measured directly by means of a load cell strain gage transducer or by monitoring the pressure trace of the back-up fluid.

The invention is particularly adaptable to a multiple die station press by providing an independently controllable back-up force for each of the die stations. Separate load cells or pressure monitors are provided for each of the back-up cylinders, and the back-up loading is independently monitored for each of the stations and adjusted as needed. The advantage to this arrangement is that if a particular die station tooling would wear at a premature rate, the back-up force would remain constant, thereby compensating for the wear without effecting the loading and effective shutheight of the other tooling stations within the die set. Similarly, tool wear conditions requiring tool force increase can be accommodated with dynamic adjustment of the individual die station. Independent feed back systems could be provided for each of the die stations or any combination of stations could be equally adjusted, so that the part quality resulting from die operations at individual stations or closely related groups of stations can be monitored and the back-up force independently adjusted for the various die or group of die stations.

BRIEF DESCRIPTION OF THE DRAWINGS

In the figures of the drawings, like reference numerals identify like components, and in the drawings.

DESCRIPTION OF THE PREFERRED EMBODIMENT

Figure 5:
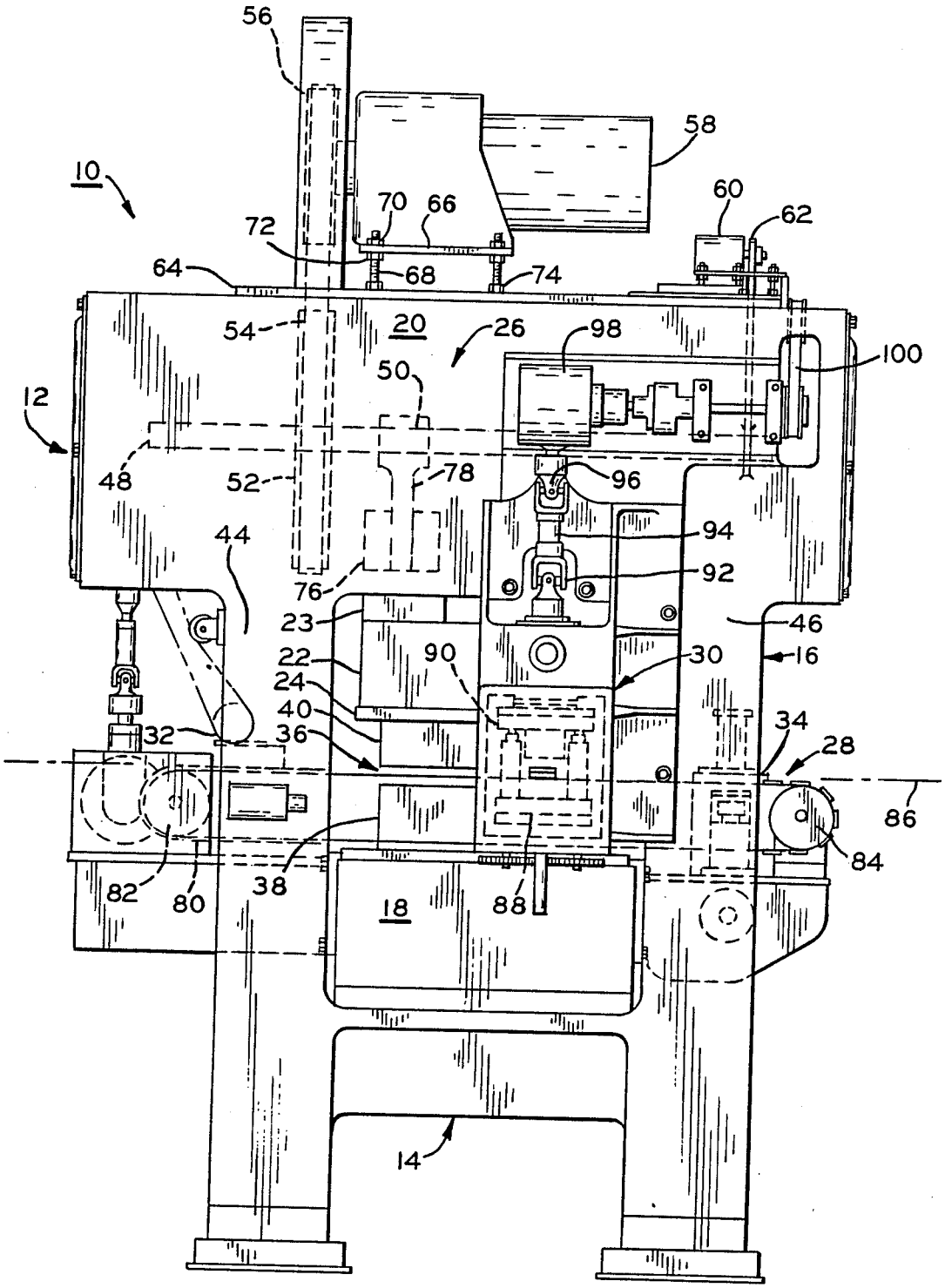
FIG. 5 is an elevational view of an exemplary press assembly incorporating the present invention.

The present invention provides a monitor and feedback control system and a dynamically adjustable tool arrangement for a press, for example, the tooling and press 10 shown in FIG. 5. Press assembly 10 comprises a main press 12 including a bed 14, a frame 16, a quick-open bolster 18 and a crown 20 vertically positioned above bed 14 and quick-open bolster 18. Slide 22 and slide plate 24 are coupled to and operable by drive assembly 26 mounted in crown 20. Press assembly 10 includes a belt transfer conveyor 28 for the transfer of workpieces, such as can ends, and a tab press 30 mounted on the frame and laterally displaced from the transfer conveyor. Can end blanks are provided through a downstacker 32 and an upstacker 34 is mounted on press 12 for ejection of formed can ends from belt 28. Downstacker 32 and upstacker 34 are located at opposite ends of transfer belt 28 outside working zone 36 defined between slide 22 and bolster 18.

Figure 4:
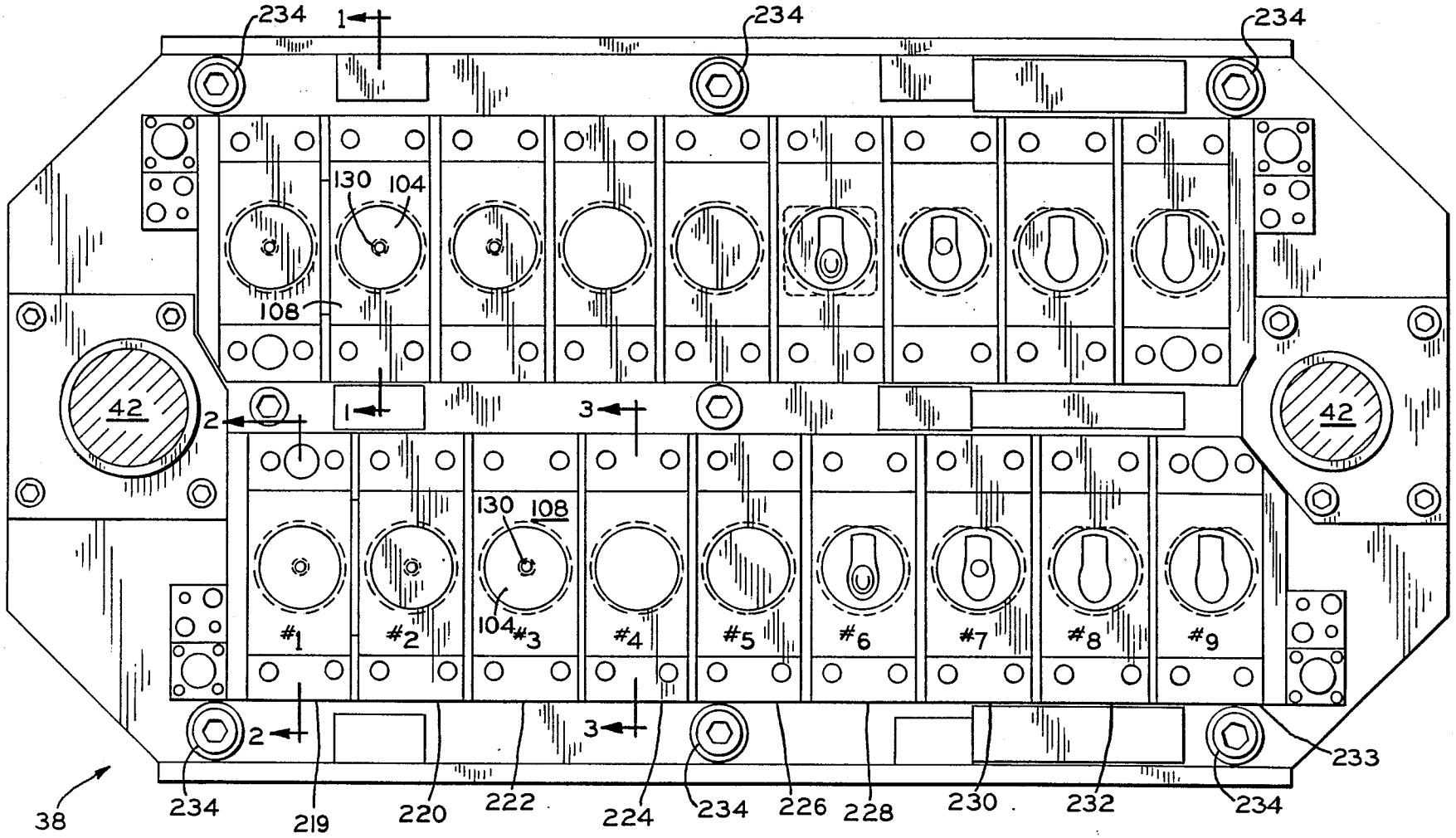
FIG. 4 is a top plan view of a dual-lane press lower die area for the forming of can ends.

Main press 12 has lower tooling 38 mounted on bolster 18 within frame 16 and upper tooling 40 mounted on slide 22 in vertical alignment and defining therebetween working zone 36. FIG. 4 illustrates the transfer belt in a top view, as discussed below. This press assembly is merely an example of one which may be used in a particular embodiment of the present invention, but it is not a limitation.

Slide 22 may be mounted on guideposts, such as guideposts 23 in FIG. 5, that are rigidly connected to and extend downwardly from a connection to piston 76. Slide 22 is adaptable to move on guideposts 23 in a reciprocating manner in opening 36 between crown 20 and bolster 18 and between left and right upright pairs 44 and 46, respectively.

Drive assembly 26 has a crankshaft 48 with at least one eccentric 50 and is rotatably supported in main bearing blocks (not shown). The drive assembly further comprises clutch and brake elements operable with crankshaft 48 as known in the art. A flywheel 52 is rotatably mounted on crankshaft 48 and driven by flat belt 54. Belt 54 is disposed around motor pulley 56 driven by motor 58. When motor 58 is energized, flywheel 54 constantly rotates but does not drive crankshaft 48 until the clutch device is engaged, at that time the friction disk of flywheel 52 is gripped and the rotational motion of flywheel 52 transmitted to crankshaft 48. A solid state limit switch 60 is driven by a pulley and belt arrangement 62 from the end of crankshaft 48 and controls various press functions, as known in the art.

Motor 58 is connected to crown cover plate 64 through mounting plate 66 by bolts and studs 68 with locknuts 70, 72 and 74. The tension on belt 54 can be varied by repositioning plate 66 on studs 68 by adjustment of locknuts 70 and 72 or studs 68.

Press 12 is dynamically balanced to counteract the movement of connection assemblies and slide 22 with a balancer weight connected to an eccentric similar to eccentric 50. Pistons 76 are operably connected to slide 22 and connecting arm 78, which is coupled to eccentric 50 and crankshaft 48.

Transfer conveyor 28 has a multi-lane continuous belt 80 operable between drive pulley 82 and idler pulley 84, the former being driven by a gear box. Belt 80 defines a horizontal plane 86 generally parallel to bed 14 and bolster 18 and has multiple workpiece carriers, which index through workstations in working zone 36 between tools 38 and 40. Belt 80 may include a series of holes engageable with sprocket teeth (not shown) on pulley 82 and 84 to index belt 80.

Tab press 30 includes a bolster 88 and slide 90. Lower tab tooling is mounted on bolster 88 and upper tab tooling is mounted on slide 90, with the tab press working zone defined therebetween. Tab press bolster 88 is generally parallel to plane 86 of conveyor 28. Slide 90 is operably connected to the tab press crankshaft. The tab press crankshaft is connected to crankshaft 48 through a universal joint 92, tab press crankshaft 94, a second universal joint 96, a change direction gearbox 98 and a belt 100.

Main press 12, tab press 30, transfer conveyor 28, downstacker 32 and upstacker 34 are all synchronously operable in plane 86 with the reciprocation of slide 22 to index between the stations of tooling 38 and 40 within working zone 36.

Main press 12 and tab press 30 are independently adjustable, for example, the shutheight of each press can be independently adjusted by utilizing standard shutheight adjusting mechanisms. The shutheight, as applied to a vertical press, is the distance from the top of the bed to the bottom of the slide with the stroke down and the adjustment up. On moving bolster presses, the shutheight is measured from the top of the bolster, when it is integral with the carriage, or from the carriage, when the bolster is separate. The stroke lengths of the presses can be independently selected.

Figure 1:
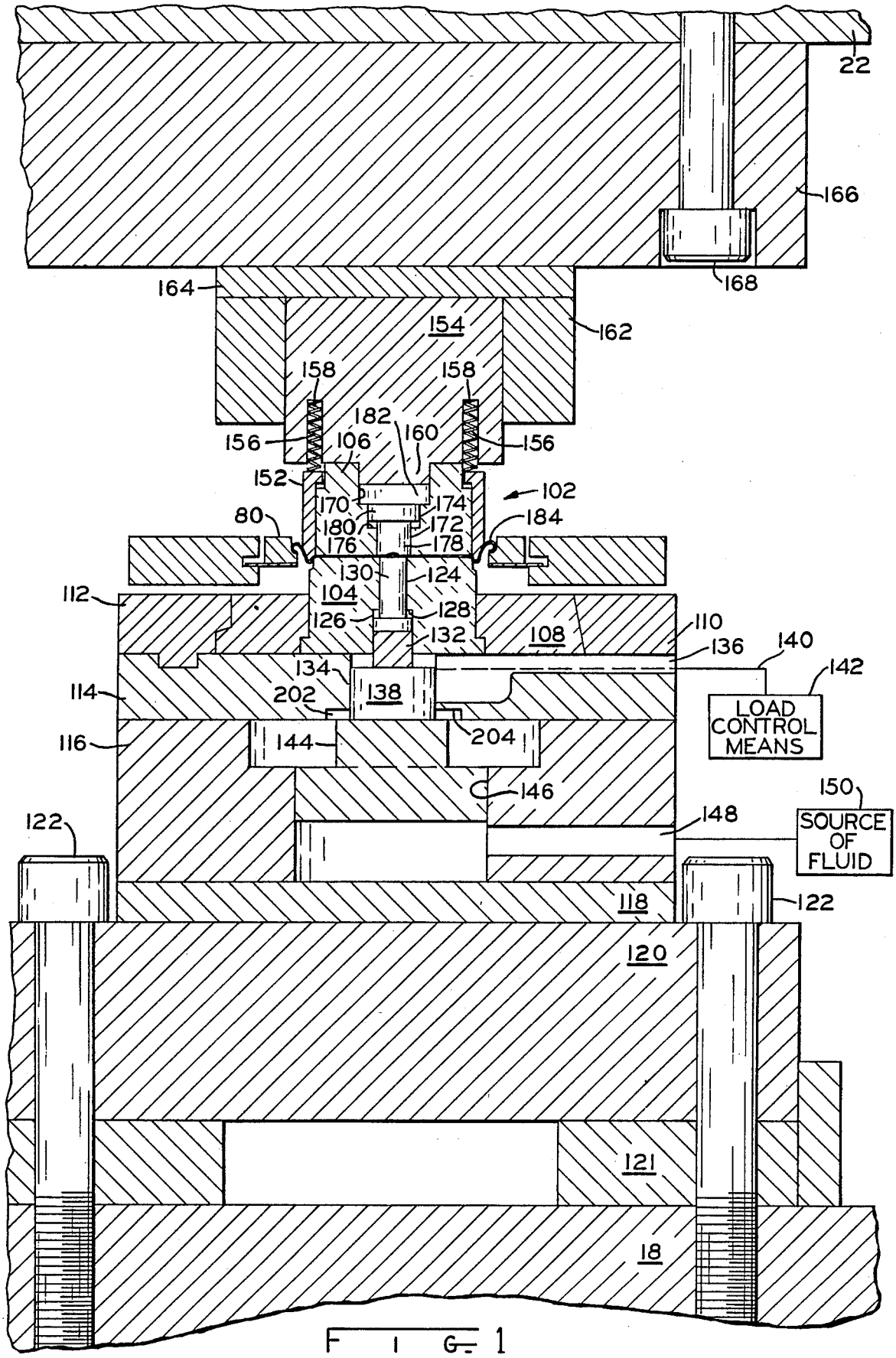
FIG. 1 is a sectional view of a press tooling arrangement taken along line 1—1 of FIG. 4 in accordance with an embodiment of the present invention.
Figure 2:
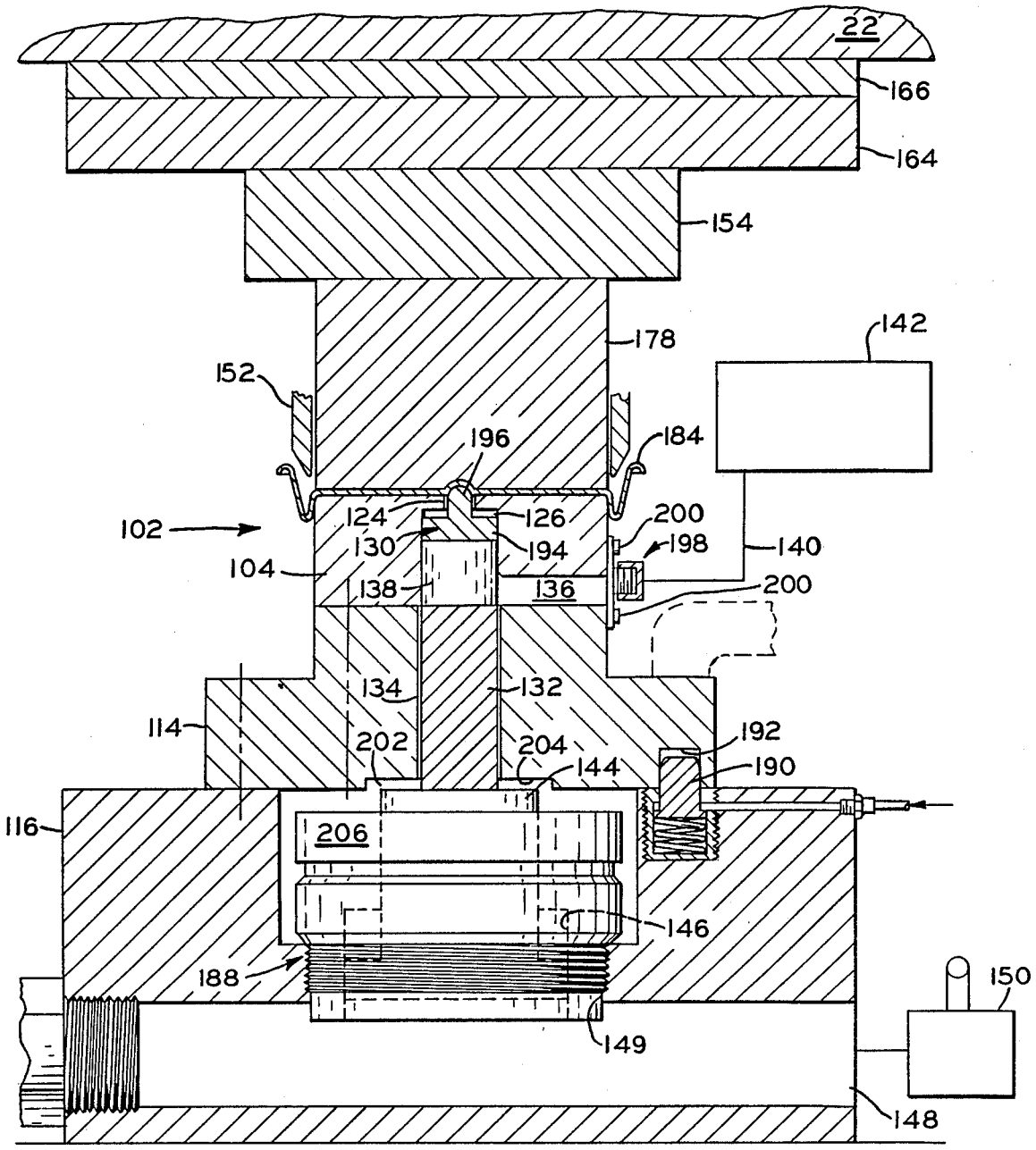
FIG. 2 is a sectional view along line 2—2 of FIG. 4'.
Figure 3:
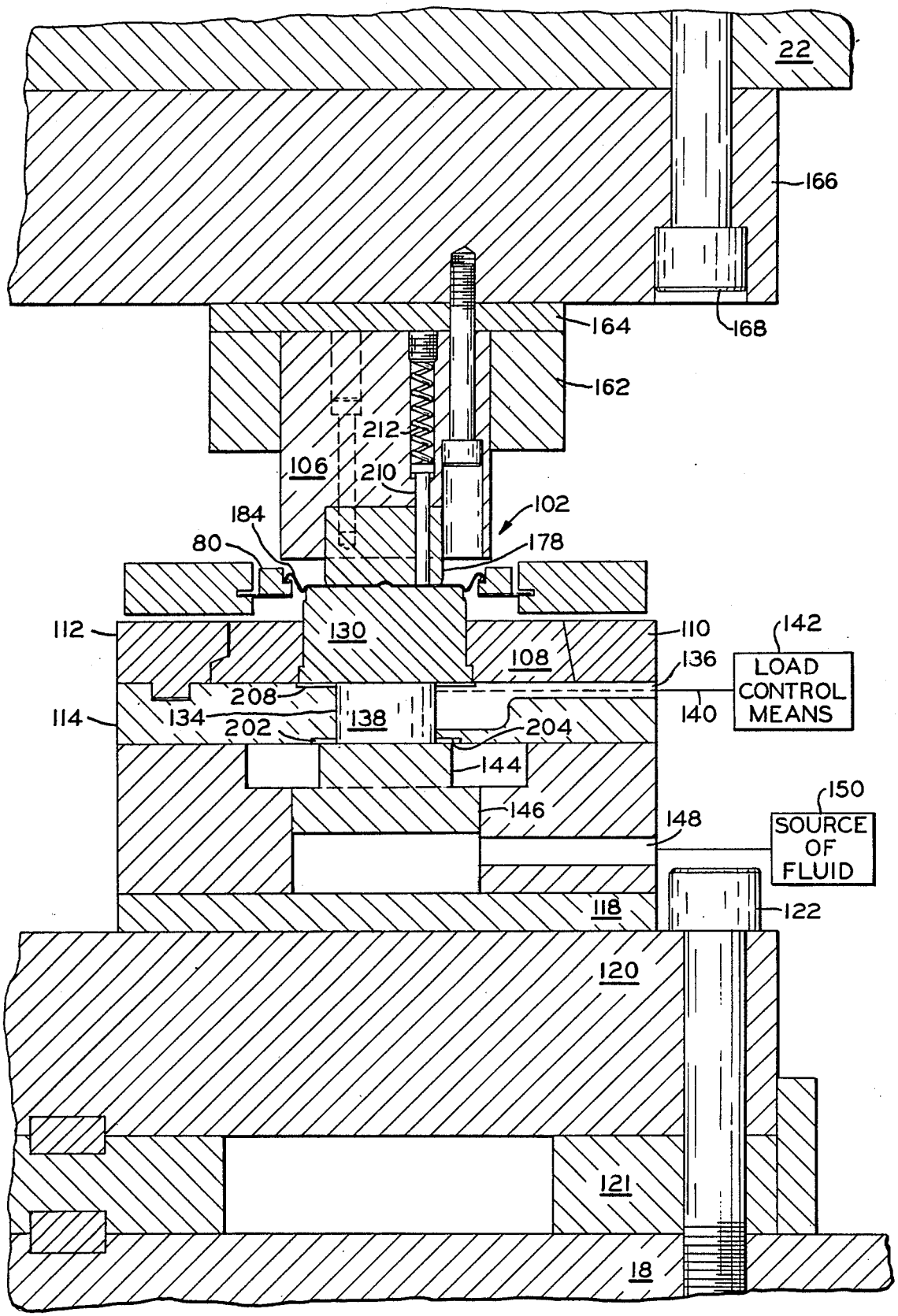
FIG. 3 is a sectional view of an alternative embodiment of a tooling arrangement along the line 3—3 in FIG. 4.
Figure 6:
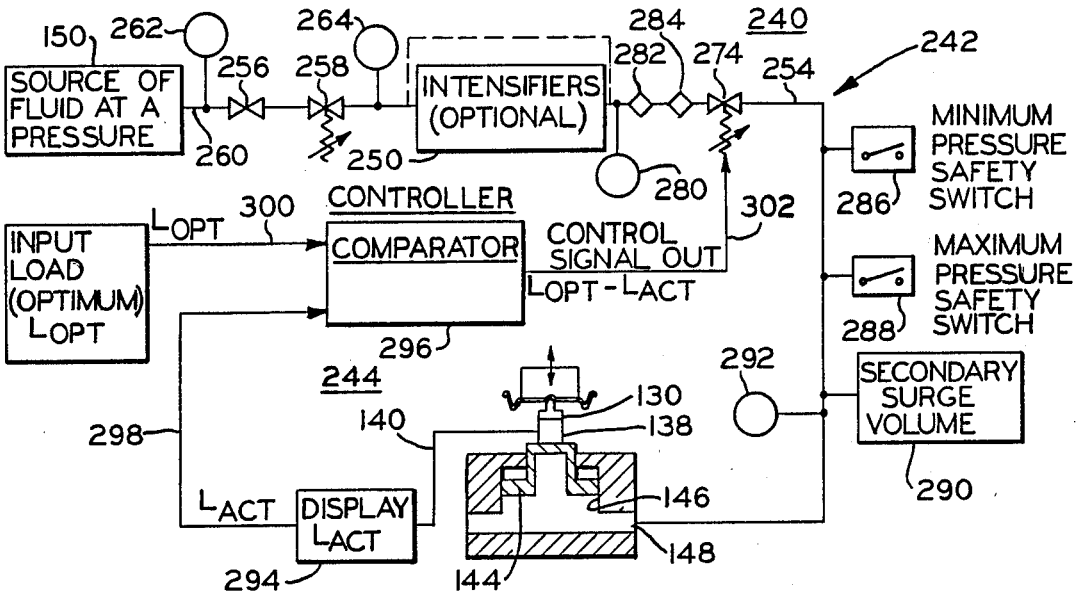
FIG. 6 is a block diagram of a back-up pressure control circuit according to one embodiment of the invention.

The present monitoring and feedback control system is operable to dynamically control the tool loading of a press assembly, such as press 10, during press operation, thereby maintaining the quality of the parts produced from the tooling within the specified manufacturing tolerances. More specifically, the tooling is dynamically adjustable, either manually or automatically, in response to tool loading, a line pressure and/or parts measurement and monitoring, through a feedback response circuit, which can provide continuous tool adjustment during press operation. Exemplary tooling arrangements for cooperation with the monitoring and feedback control system are shown in FIGS. 1–3. A control system or circuit 240, illustrated diagrammatically in FIG. 6, is provided to control the tooling arrangements shown in FIGS. 1–3.

In FIG. 1, a tool assembly 102 has a lower tool housing 104 and an upper tool housing 106. Lower tool housing 104 is mounted in a lower tool clamping plate 108 secured in lower tool alignment blocks 110 and 112 mounted on lower tool retainer 114. Lower tool housing 104 is secured to a constant load cylinder housing 116 through lower tool retainer 114. Constant load cylinder housing 116 is rigidly connected to and operable with bolster 18 of a press assembly through optional ground spacer plate 118 and lower die shoe 120, which is secured to bolster 18 through spacer block 121 with screws 122. Alternatively, a fluid-backed slide and upper tool arrangement is considered to be within this description with only minor changes or variations.

Lower tool housing 104, as shown in FIG. 1, includes a bore 124 and a counterbore 126 with a shoulder 128 at their junction Lower tool insert 130 is received and slidable in bore 124. A load transfer device 132, which may be a solid block, multiple blocks or shims, is positioned in counterbore 126 and contacts tool insert 130.

Lower tool retainer 114 includes a chamber 134 and a channel 136 generally extending from chamber 134 to the exterior of retainer 114. A load cell or sensor 138 for sensing the tool load is mounted in chamber 134 with lead wires 140 extending from load cell 138 through channel 136 to a load control means or a display 142. The load control means 142 may comprise a microprocessor, or a comparator to receive input signals and provide output or control signals as a function of these inputs or it may be a calibrated display device. Load cell 138, for example a model ALD-W or an ALD-MINI-T by A. L. Design, Inc., is compressed between load transfer device 132 and piston 144, and is operable to provide an electrical input signal, $L_{act}$, indicative of the actual load on tool 130. Alternatively, tool 130 could extend through counterbore 126 to directly contact load cell 138.

Constant load cylinder housing 116 defines a cylinder 146 with piston 144 movable therein and a fluid chamber 148 communicating between cylinder 146 and a source 150 of fluid (liquid or gas) at a pressure. Piston 144 contacts load cell 138, or in some cases load transfer device 132, and is operable to vary the force acting on tool 130 to maintain a consistent load on a material during forming operations. Maintaining tool loading or force in response to the load monitored by sensor 138 will be explained in greater detail.

Upper tool housing 106 is aligned and secured to upper tool retainer 154. Backup springs 156 are located in blind-hole passages 158 in retainer 154 to contact and bias end conversion shell alignment ring 152. Upper tool retainer 154 with a projection 160 is mounted and located in upper tool alignment collar 162. Both collar 162 and retainer 154 are mounted against background spacer 164 and upper tool shoe 166, which is secured and operable on slide 22, of FIG. 5, by cap screws 168.

Upper tool housing 106 comprises a bore 170 and an upper tool bore 172 with a counterbore 174 and a shoulder 176 therebetween. Upper tool insert 178 has a collar 180 and is mounted in tool passage 172 with collar 180 in counterbore 174. A shim 182 is illustrated in bore 170 contacting collar 180 and projection 160 of retainer 154, although projection 160 could extend to directly contact collar 180 and thereby eliminate the need for shim 182.

In FIG. 1, a forming operation utilizing upper tool 178 and lower tool 130 is illustrated with stock material 184 interposed between tools 178 and 130 and retained by a material retainer, such as a shell carrier retainer 186 of belt 80 in FIG. 5. Upper tool 178 and lower tool 130 thereafter are operable by slide 22 and bolster 18, respectively, to form or partially form material 184. The particular type of tooling shown in FIG. 1 is merely exemplary as it shows a particular step in the formation of a beverage can end. However, the invention is not limited to the specific structure of the tooling illustrated nor to the specifically discussed product.

A dual-lane press die arrangement is shown in FIG. 4, specifically a press arrangement for the formation of can ends. In this illustration, die tooling alignment guides 42 are located at either end of the tooling stations forming the die set, and lower tool clamping plate 108, lower tool housing 104 and lower tool insert 130 are shown The lower tool and die arrangement is provided for multiple can end conversion operations, specifically: optional first station 219; second station 220, formation of a pre-bubble; third station 222, button forming and coining of area around the button; fourth station 224, incising, embossing and lane identification; fifth station 226, scoring the lid; sixth station 228, forming the c-bead and panel; seventh station 230, tab staking to the shell; eighth station 232, tab ear wipe down; and, optional ninth station 233, doming the lid. This particular arrangement is merely indicative of the type of tooling arrangement utilized for this particular forming operation. The various stations 219 to 233 will have different individual tools, however, the tool orientation or position for each tool will generally be the same within the die assembly. As can be appreciated, the stock material, such as a can end, is progressively moved in a transfer belt from at least the second to the seventh station (optionally from the first to the ninth station) for successive forming operations. The lower multiple tool and die assembly, including tool die shoe 120, is secured to spacer block 121 and bolster 18 by screws 234. Although the tooling for only a single station has been described above in FIG. 1, it is understood that each remaining station is provided with similar tooling for that station's particular forming operation. Each tool or die station is preferably provided with a separate, independent back-up load and control system, which is operable at the center of the load for each station.

FIG. 6 is a schematic illustration of one embodiment of a control circuit 240, comprising both the fluid circuit 242 and electrical circuit 244, for the control and feedback system of the present invention. Pressure source 150 may include a pneumatic pressurized source, such as an air supply 246 of FIGS. 10 and 11, or a pressurized gas (nitrogen) supply 248 of FIG. 12, for example, to pressurize fluid passage 148 and cylinder 146. Alternatively, a hydraulic fluid may be utilized to pressurize fluid passage 148, which may be a primary surge volume, to exert force on piston 144. Air supply 246 (FIGS. 10 and 11) is coupled to one of the illustrated optional air intensifiers 250 and 252, depending upon which control fluid (i.e., pneumatic or hydraulic) is utilized. The pressurized control fluid is communicated to a fluid conduit 254 for transfer through fluid circuit 242 to passage 148 and cylinder 146.

Figure 10:
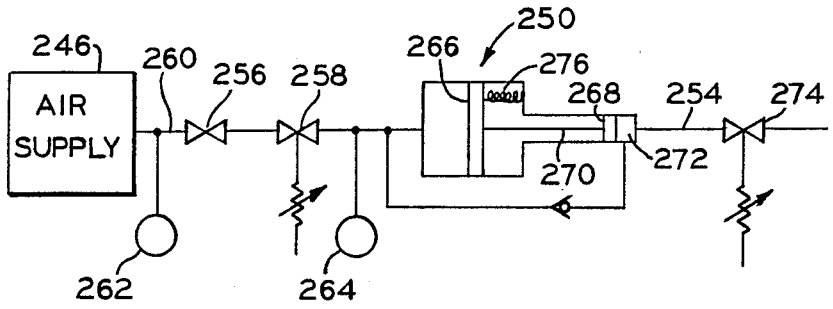
FIG. 10 shows an air-air intensifier for the fluid circuits of FIGS. 6 to 9.
Figure 11:
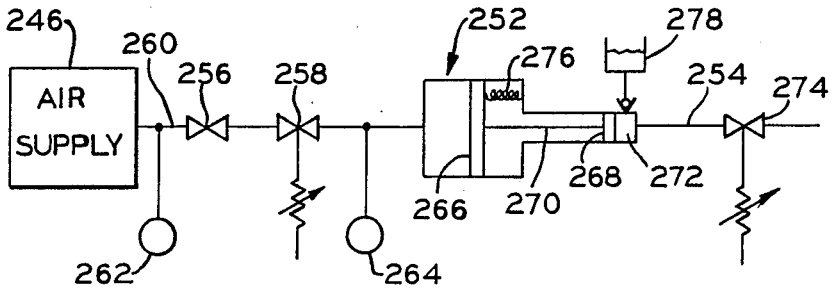
FIG. 11 shows an air-hydraulic intensifier for the fluid circuits of FIGS. 6 to 9.

In FIG. 10 air or nitrogen supply 246, 248 is coupled to an air intensifier 250 through a shut-off valve 256, a first adjustable self-relieving gas regulator 258 and conduit 260. In addition, pressure gauges 262 and 264 are coupled to conduit 260 upstream and downstream, respectively, of valves 256 and 258. Air intensifier 250 is shown in FIGS. 10 and 11 as a dual piston arrangement with pistons 266, 268 and a connecting rod 270 therebetween. A volume of air is provided to small volume 272 in intensifier 250 for compression and communication to conduit 254, continuously servo controllable, self-relieving regulator 274 and fluid chamber 148 of the tool arrangement 102. The air intensifier is utilized to provide a predetermined pressure to conduit 254 and servo-controlled, self-relieving regulator 274. Piston 266 is biased by spring 276 to a reference position at an unpressurized condition in conduit 254.

The hydraulic fluid intensifier 252 is illustrated in FIG. 11 with a source of hydraulic fluid 278 coupled to small piston volume 272 for compression by pistons 266 and 268. The compressed fluid is communicated to conduit 254 and regulator valve 274.

Figure 12:
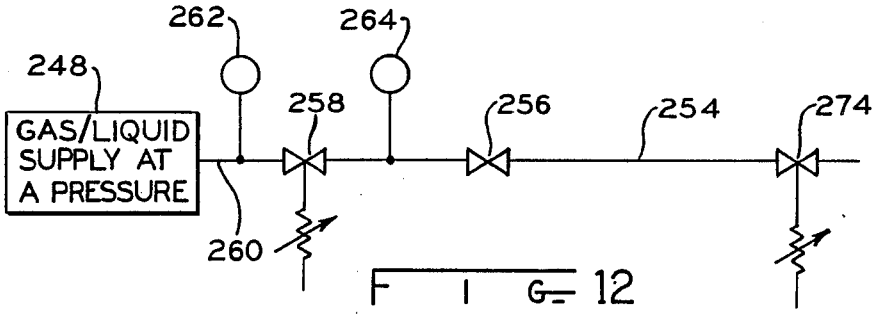
FIG. 12 shows a fixed fluid pressure source operable with the fluid circuits in FIGS. 6 and 7.

As shown in FIG. 12, a pressurized fluid supply 248, such as nitrogen or air at a known pressure, may be utilized as the control fluid, which is controllable by a first adjustable self-relieving gas regulator 258. The regulator 258 may be a manual device or a servo controlled device responsive to an electrical signal, which servo device controls the pressure and/or flow rate through the regulator. In this case, shut-off valve 256 is positioned in conduit 260 downstream of air regulator 258.

Control circuit 242 of FIG. 6 will be described with particular reference to FIG. 10 and FIG. 1 wherein the tooling and load cell are in the lower tool arrangement. However, it is understood and appreciated that the alternative control arrangements noted above are operable with the control circuit with minor variations known in the art and the load cell could be positioned in the upper tool assembly. In FIG. 6, a second adjustable air regulator 274 is interposed in conduit 254 between intensifier 250 and chamber 148. Pressure gage 280, filter/strainer 282 and lubricator 284 are coupled to conduit 254 downstream of intensifier 250 and upstream of second regulator 274, although utilization of these elements and their location are optional with the designer. Downstream of second regulator 274 are an adjustable minimum pressure safety switch 286, an adjustable maximum pressure safety switch 288, a secondary surge volume 290, and a pressure monitor 292. These components may be provided for a particular application but are not required. Switches 286 and 288 may be operable to stop the press or provide warning signals in response to an overpressure or underpressure condition, respectively. In this embodiment, fluid at a pressure regulated by regulator 274 is communicated to primary surge volume 148 and pressurizes control piston 144 to provide a controlled back-up load on tool 130.

Conductor 140 from load cell sensor 138 is coupled to an optional signal display 294 for display of the load cell signal. Signal display 294 is calibrated as a function of the load on tool 130 and 178 to display the force load on the tool 130 as sensed by sensor 138. The signal from load cell 138 is conducted to a controller 296 through line 298. Controller 296, which is illustrated as a comparator, receives an input signal on conductor 300, such as an optimum or desired input load, and the sensed load cell signal indicative of the actual tool load. Controller 296, which may be a comparator or a microprocessor, is operable to compare the desired input load signal and the actual tool load to communicate a control error signal through conductor 302 to servo-controlled regulator 274. The optimal load signal on line 300 may be a predetermined value. Alternatively the load signal on line 300 may be a determinable calculated value or a pre-established load signature value correlated to previously known and acceptable quality production as a function of operating parameters such as temperature, speed or tool penetration. For example, visual inspection devices 312, such as diagrammatically illustrated in FIG. 20, or devices for measuring the penetration of the tool can also provide input signals to a microprocessor or controller, which can be programmed to interpret the input signals as corresponding to an acceptable or unacceptable part. The microprocessor would then provide an output signal to regulator 274 to change the setting of the regulator to increase or decrease the fluid pressure within cylinder 146. If the tool has not penetrated far enough, the back-up force will be increased by increasing the pressure, and if the tool penetration is too great then the back-up force will be decreased by lowering the pressure. In addition, manually measured dimensions or parameters can be provided to comparator 296 through line 300 as a measure of product part quality.

Air regulator 274 may be a servo device responsive to the control signal to control the pressure in chamber 148 to thus control the back-up load on tool 130. The back-up load and tool load are correlative values. Tool penetration into the stock material, and thus the energy required to form the finished product, are likewise related to the tool load. Therefore, feedback control of the tool load through the back-up load provides continuous control of tool penetration, which correlates to product quality. Continuous control of tool penetration obviates the necessity of utilizing over travel and kiss blocks to maintain adequate tool penetration, to thus relieve the stress on the press and the necessity to provide excess energy for the part formation. Impliedly this will lead to the use of presses designed for lower tonnage (force) levels. As the tool load is continuously monitored throughout the operating cycle of the press the tool or tools will be continuously adjusted by adjustment of the back-up load without stopping the press. In addition, this tool variation will effectively adjust the shutheight for the selected individual tool or combination of tools. A manual override can, of course, be utilized by the operators for safety purposes, tool set-up, maintenance, etc., as known in the art.

Controller 296 can be a preprogrammed microprocessor capable of receiving an electrical signal through line 298, that is sensed tool load. The microprocessor can determine an output control signal by various means, such as comparison of the sensed signal to a look-up table value with empirical data; by calculation of a desired tool load and thus a desired pressure in passage 148 based on operating parameters; or by other analytic means. This desired control signal is compared to the actual pressure signal from monitor 138.

As indicated earlier, separate control and monitoring is provided for each of the die stations within the die set so that individual adjustments can be made where necessary due to individual tool wear, part quality degradation at a particular forming station, etc. Each of the controllers illustrated in FIG. 6 could be replicated for the individual die stations, or a central microprocessor could be utilized to provide the monitoring and control function on a time division multiplex basis, if desired. Although the automatic feed back control system is preferred, it is also possible to perform back-up load control by a manual technique wherein individual die stations are controlled independently. For example, a visual inspection of the part could indicate that one of the forming operations is out of specification, and the pressure for that particular die station can be increased or decreased as necessary to bring the forming step back into specification limits.

There are a number of parameters which can be monitored and utilized to provide back-up load adjustments or to produce error signals which automatically control the back-up force and thus product quality. Such parameters include the following:

(1) manual monitoring of part quality;

(2) video inspection monitoring of part quality;

(3) monitoring total tool load via press mounted strain instrumentation;

(4) monitoring individual tool station performance and load via strain instrumentation mounted in each station;

(5) monitoring individual tool station performance and load via piezoelectric instrumentation mounted in each station;

(6) monitoring individual tool station performance via hydraulic pressure monitoring;

(7) monitoring individual tool station performance via pneumatic or nitrogen pressure monitoring;

(8) monitoring individual tool station performance via vibration signal signature monitoring;

(9) monitoring individual tool station performance via acoustic emission signal monitoring;

(10) monitoring individual tool station performance via spectral signal analysis;

(11) monitoring total tool load via die subplate mounted instrumentation;

(12) monitoring individual tool load and total tool load via die subplate with individual movable stations strain or piezoelectric instrumentation;

(13) monitoring of tool setup via strain gauged kiss blocks; and

(14) monitoring of critical tool station setup and performance via individual tool station kiss blocks which are strain gauged or otherwise instrumented.

Figure 7:
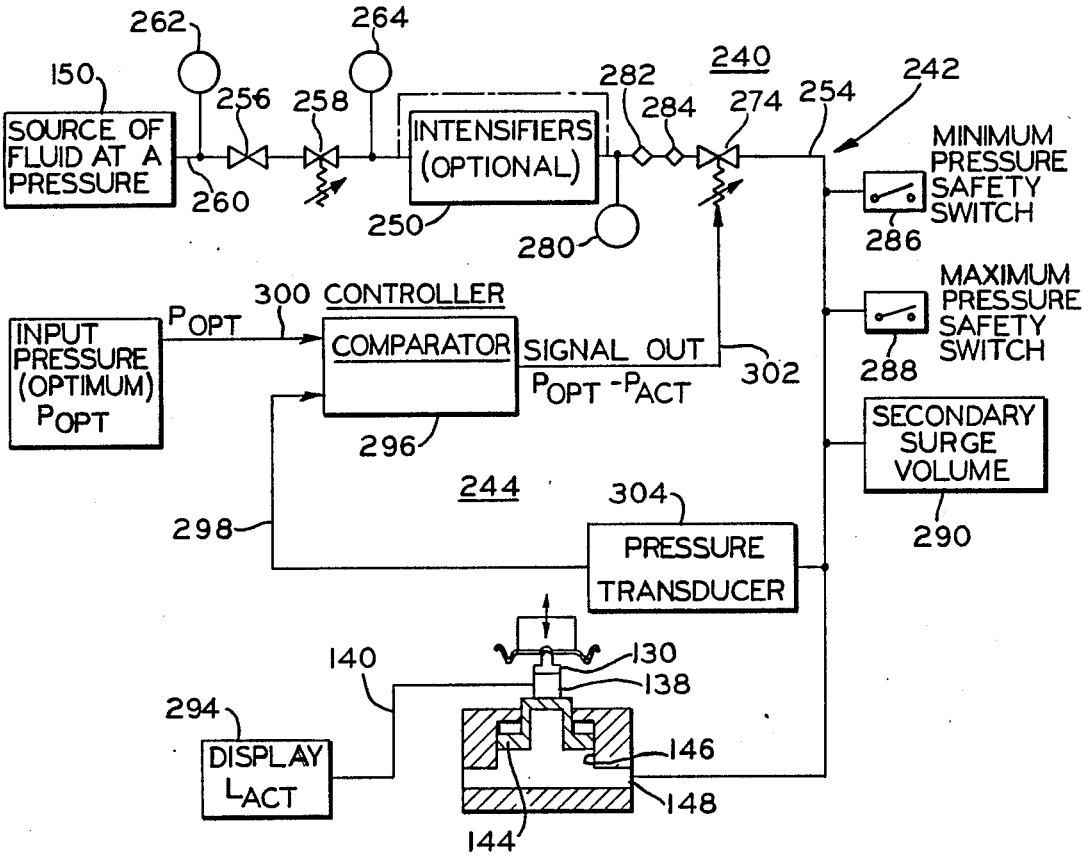
FIG. 7 is an alternative embodiment of the back-up pressure control circuit in FIG. 6.

A further embodiment of the above control system, as shown in FIG. 7, provides a pressure transducer 304 coupled to line 254 upstream of fluid passage 148 and operable to provide an input pressure signal to controller 296 through conductor 298. This pressure signal is indicative of the back-up load (line pressure) and thus the tool load. An input pressure signal, which is indicative of the optimal or desired line pressure correlative with acceptable tool penetration and thus quality part production, is communicated to controller 296 through line 300 from a lookup table, manual control, microprocessor or the like. As above, controller 296 could be a comparator for comparison of a fixed input signal or a microprocessor operable to receive multiple input signals for comparison with the actual signal for determination of the control signal communicated to regulator 274 through line 302. Regulator 274 is varied by comparator 296 to maintain the fluid pressure in conduit 254 to control the back-up load on piston 144 and consequently the tool load on tool 130.

Figure 8:
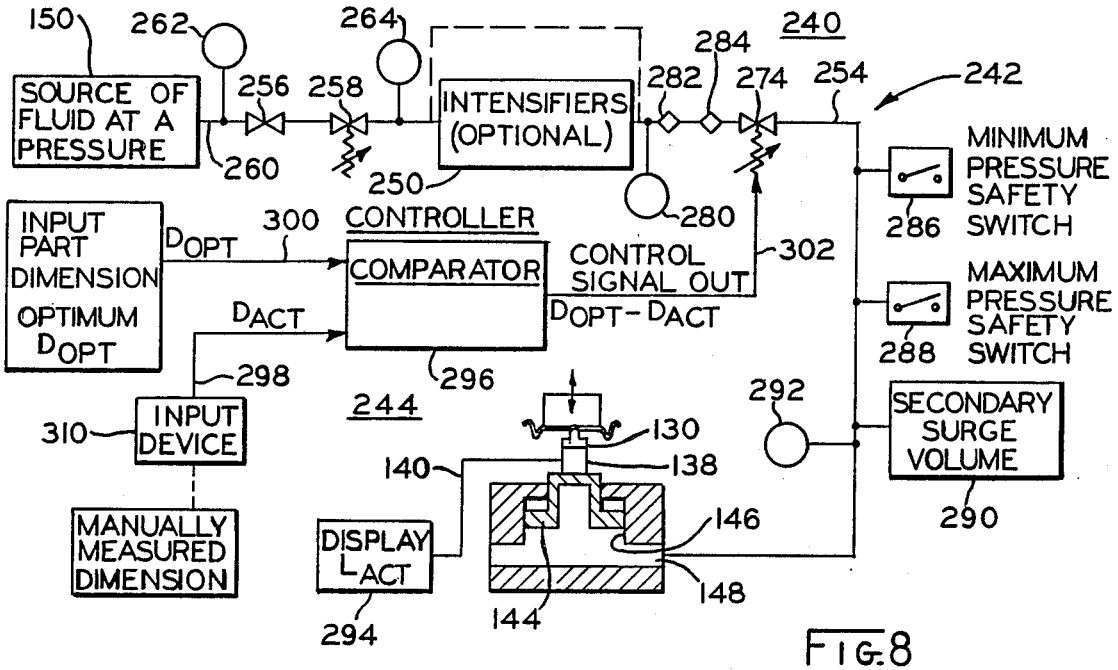
FIG. 8 is a further embodiment of a back-up pressure control circuit.

Another embodiment of the control system, as shown in FIG. 8, provides an input device 310, such as a CRT and keyboard, which receives manually measured dimensional data for individual parts. The measured dimensions are provided to controller 296 through conductor 298. An input dimension signal, which is indicative of the optimal or desired dimension correlative to acceptable tool penetration and thus quality part production, is communicated to controller 296 through line 300. Controller 296 could again be a comparator for receiving multiple input signals for comparison with the actual signal and for determination of an output control signal communicated to regulator 274 through line 302. Regulator 274 is thus varied in response to the control signal to control the fluid pressure in line 254 to control the back-up load on piston 144 and thus the tool load on tool 130.

Figure 9:
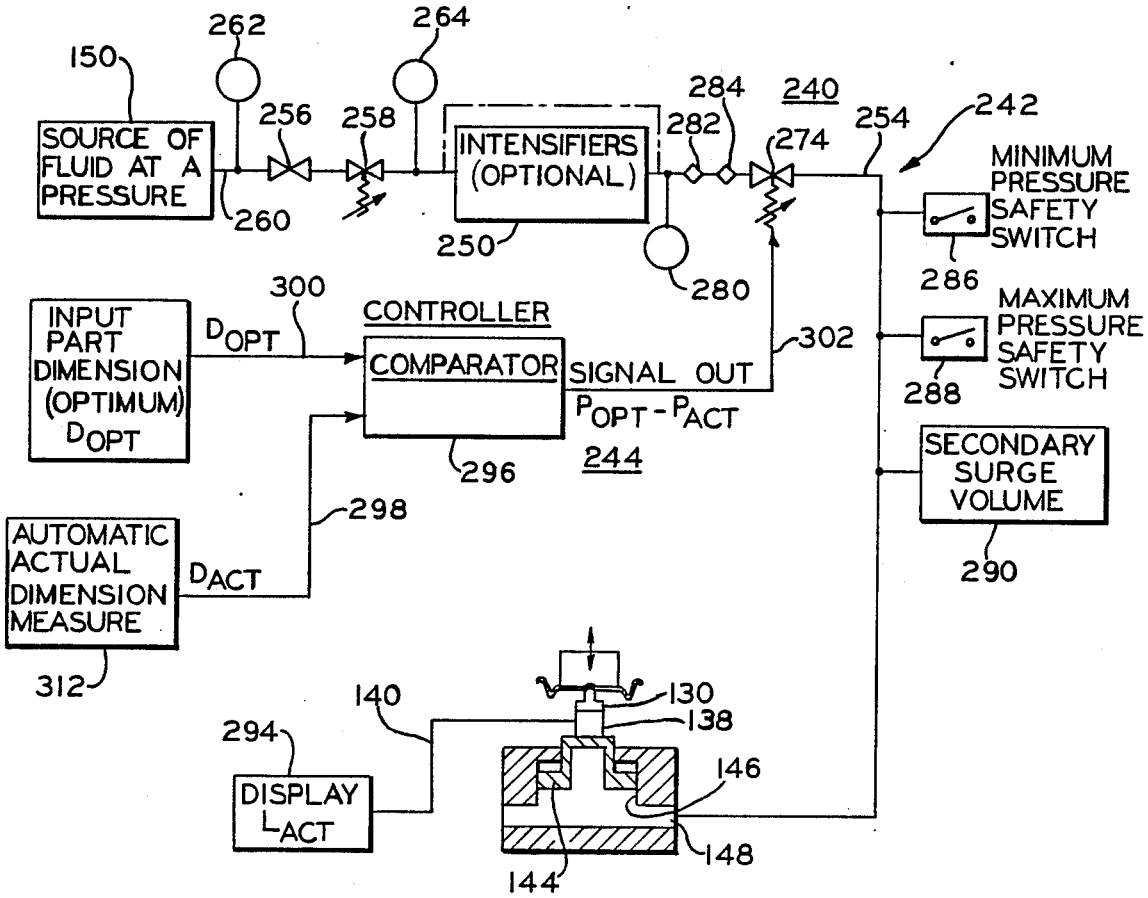
FIG. 9 is another embodiment of a back-up pressure control circuit.
Figure 20:
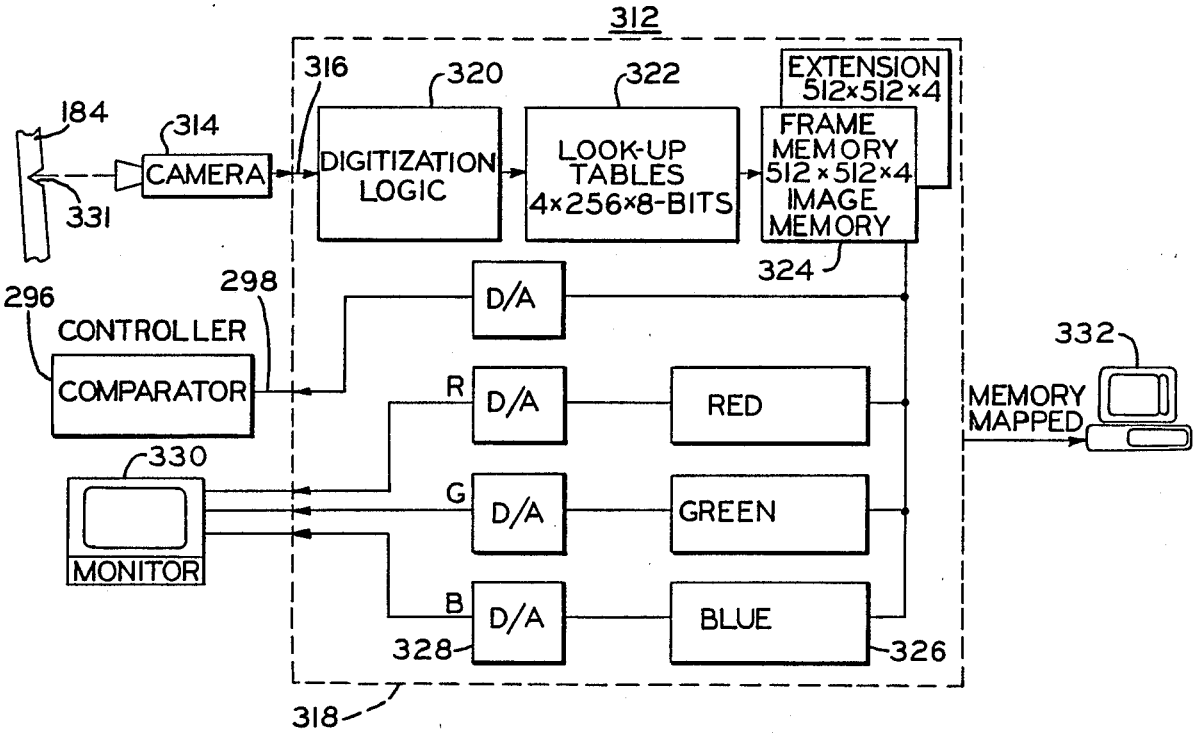

FIG. 9 illustrates a further embodiment of the above-noted control system, which provides an automatic part dimension measurement device 312, such as a video inspection device, a fiber optic or x-ray sensor, as illustrated in FIG. 20, operable to provide an actual dimension input signal to comparator 296 through conductor 298. An input dimension signal, which is indicative of the optimal or desired dimension, is again communicated to controller 296 through line 300. The part dimension signals from devices in 310 and 312 above in FIGS. 8 and 9, respectively, are provided to controller 296. As noted above, controller 296 could be a comparator for comparison of the actual signal (part dimension) to the desired input signal (desired or optimal part dimension). Regulator 274 is coupled to comparator 296 to receive a control signal through line 302. Regulator 274 is again varied by comparator 296 to maintain the fluid pressure in conduit 254 to control the back-up load on piston 144 and thus the load on tool 130.

FIG. 2 illustrates an alternative embodiment of the tool arrangement 102 of FIG. 1 and provides a detailed configuration of a back-up cylinder assembly 188 in a constant load cylinder housing 116. Lower tool retainer 114 in FIG. 2 is illustrated with a spring-biased, positive station locating device 190 extending into a locating bore 192 to positively locate retainer 114. Locating device 190 is screw threaded into housing or manifold 116. Lower tool housing 104 includes lead wire chamber 136 communicating between counterbore 126 and the exterior of housing 104. Lower tool insert 130 comprises an optional flange 194 and a protuberance 196 extending through bore 124 to form can end material 184; and, insert 130 and load cell 138 are serially arranged in counterbore 126. Lead wire 140 extends through passage 136 and through a cover and seal arrangement 198, which is secured to lower tool housing 104 and retainer 114 by screws 200 to seal passage 136. Load transfer device 132, in FIG. 2, extends through bore or chamber 134 of lower retainer 114 to provide positive contact between load cell 138 and piston 144. Lower retainer 114, with a recess 202 and lower surface 204, is mounted on a complete load/pilot/clamp manifold or lower cylinder housing 116, which is utilized for modular die stations.

The manifold 116 includes fluid passage 136 communicating with pressurized nitrogen or other fluid source 150 and back-up cylinder assembly 188. Cylinder assembly 188 comprises a piston housing 206 and piston 144, which housing 206 is threadedly secured in cylinder chamber 146. However, piston housing 206 may be secured by any means known in the art. Cylinder assembly 188, such as Forward's Standard Nitrogen Die Cylinder models RFS25, 4 or 6, communicates with fluid passage 136 and is operable by the operating fluid therein. Piston 144 contacts load transfer device 132 and is operable to vary the force acting on tool 130 to maintain a consistent tool load on material 184 during forming operations.

FIG. 3 illustrates an alternative embodiment of tool arrangement 102 wherein the lower tool housing 104 and lower tool insert are integrated into a single tool 130, which directly contacts load cell 138 for transfer of the tool load to piston 144. Lead wires 140 extend through passage 136 to provide the sensed tool load to controller 142. Direct contact between load cell 138 and tool 130 eliminates the need for load transfer device 132 (FIGS. 1 and 2). The load sensors are preferably located at the center of the load for each station, which load center is not necessarily the dimensional center of each station. Utilizing the load center for each station provides the best load monitoring signal and alleviates tipping moment effects on each tool station and related components to avoid off center scoring. Fluid source 150 provides fluid at a controlled pressure to cylinder 146 to operate piston 144. Retainer 114 defines an upper recess 208 to accommodate movement of integrated tool 130. Upper tool 178 in upper tool housing 106 is secured to spacer 164 and upper tool shoe 166 with screws, such as screw 168. A spring biased separating pin 210 with spring 212 is operable through tool 178 and housing 106 to contact and separate the formed part from the tooling. Screw 168 and separating pin 210 are not limitations but are merely illustrative of ancillary tool components operable with the control system and tool arrangements of the present invention.

Figure 13:
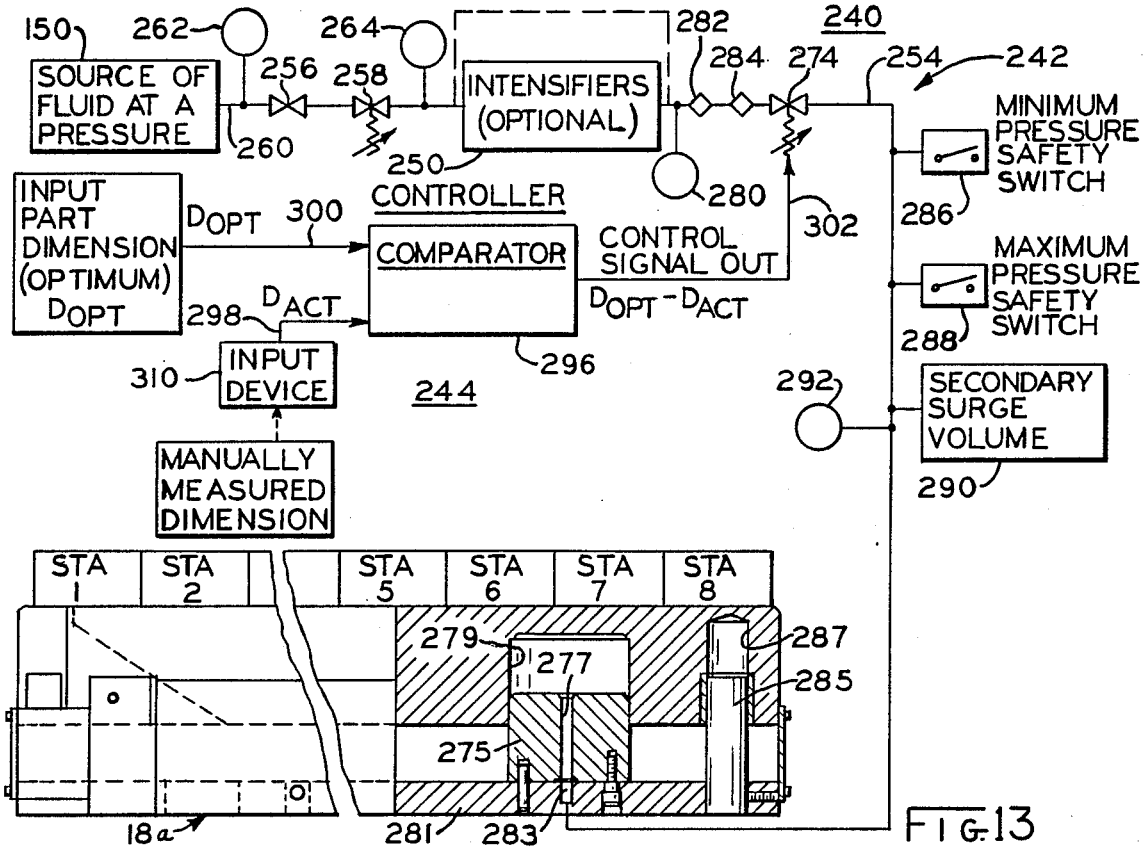
FIGS. 13–15 are alternative embodiments of a control circuit for a multi-station tool arrangement.
Figure 14:
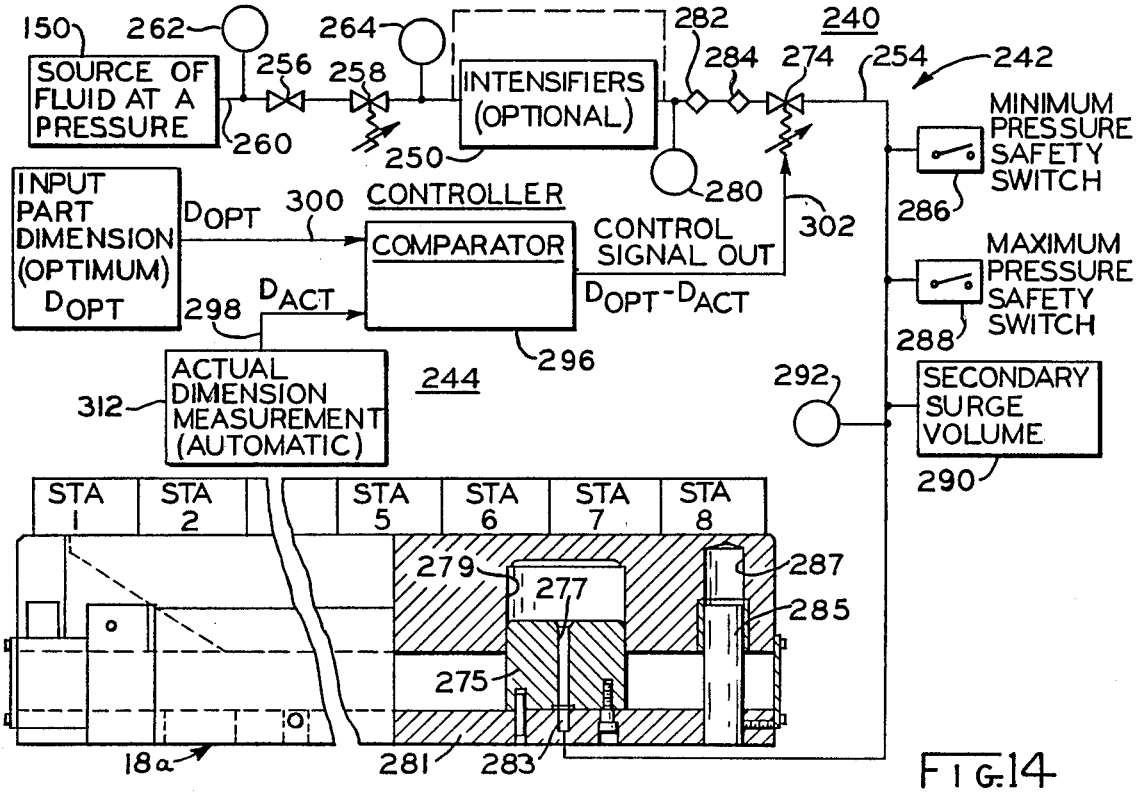
Figure 15:
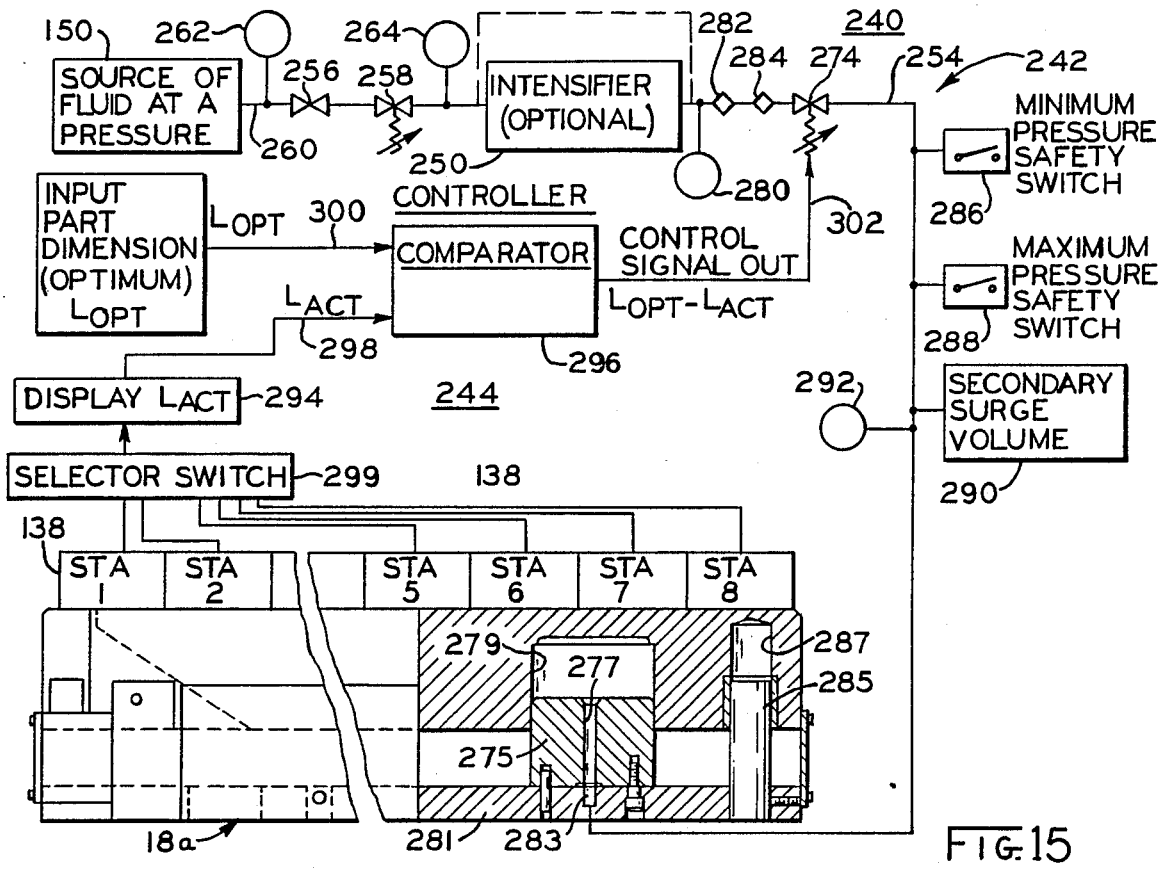

A quick open bolster 18*a* (as described in U.S. Pat. No. 4,206,699 incorporated herein by reference) with a multi-station tool arrangement coupled to control circuit 240 is illustrated in FIGS. 13–15. Bolster 18*a* is shown in partial cross section to illustrate one of the pistons 275 with an axial passageway 277 and a cylinder 279, which piston and cylinder arrangements are utilized to adjust bolster 18*a* to thus vary the shutheight as described hereinafter. Bolster 18*a* has a base plate 281 with a passageway 283 communicating between fluid line 254, axial passageway 277 and cylinder 279. Fluid under pressure is communicated to cylinder 279 to move bolster 18*a* vertically on guide pins 285 in guide bores 287. Although only one bolster piston and cylinder arrangement is shown, this is merely exemplary of a multi piston arrangement for the bolster, as known in the art.

FIG. 13 illustrates a control system for the production of a formed piece, such as a can end, with a multi station tool and die arrangement and a quick open bolster 18*a*. In this embodiment, the finished or formed piece is manually measured for a predetermined dimension, frequently a critical dimension, and this measured parameter is provided to controller 296 through an input device 310 and line 298. Input device 310 is a means for providing an input signal, such as a computer keyboard or an analog input, although this is merely exemplary and not a limitation. Controller 296 is operable to compare the measured dimension $D_{actual}$ to the desired dimension $D_{opt}$ input through reference line 300 to provide an output or control signal on line 302 based on the difference between these two values. The control signal actuates regulator means 274 to control the fluid pressure to piston 275 and cylinder 279 of bolster 18*a*. This fluid pressure elongates the bolster and thus adjusts the shutheight between the upper and lower tools (see FIGS. 1–3). The manually measured dimension, which may be a critical dimension, is correlative to the force needed to form the particular measured dimension as discussed above.

Adjustment of the bolster 18*a*, and thus the various tool stations, is accomplished by variably elongating the bolster. That is, the bolster is initially secured in a position with an adequate pressure to maintain it in position during the press operation. Thereafter, an increase in pressure in cylinder 279 increases the tensile force on the bolster securing members causing them to elongate which moves the bolster to close the shutheight. For purposes of this application the "bolster" could be located either below the lower tooling as illustrated or above the upper tooling (not shown) in order to vary the shutheight of the press.

FIG. 20 diagrammatically illustrates an apparatus utilized to monitor or measure a part dimension. This particular apparatus, which is merely exemplary and not a limitation, is available from Imaging Technology, Inc. under the designation IMAG 100 series real time image processor. These image processing devices include processing functions including thresholding, histogram equalization, plotting, stretching and logical and arithmetic operations and provide analog or digital outputs indicative of dimensional measurements. Software packages are available to provide graphic arts, auto cad and advanced mathematic functions with an array processor. This disclosure is provided to illustrate the availability of such automatic dimensional measuring apparatus and it is known that alternative assemblies are available to perform these functions. As shown, the system 312 in FIG. 20 provides a camera 314 to sense a particular dimension of a part, which camera 314 provides a sensed signal on line 316 to a circuit 318 which includes digitization logic circuit 320, look up tables 322, image memory 324, color module 326 and digital to analog converters 328 to provide an output signal or signals to a monitor 330. In addition, the circuit 318 may be coupled to a remote display device 332 for memory mapping. The signal within circuit 318 may be coupled to the controller 296 through line 298 and the digital-/analog converter to provide an output control signal correlated to represent the dimension sensed by camera 314, for example, the depth of score 331 on can end 184.

In FIG. 14, an automatic dimension measurement device 312 (FIG. 20) is operable to sense or measure a predetermined parameter of a formed workpiece to provide an input signal on line 298 to controller 296, which also receives an input reference dimension signal $D_{optimum}$ on line 300. The signals are compared and controller 296 provides an output signal on line 302 to variable regulator means 274 to control the fluid pressure to piston 275 and cylinder 279 arrangement of above-noted quick-open bolster 18*a* to again vary the shutheight for control of the force forming the formed piece.

FIG. 15 illustrates quick-open bolster 18*a* with a multi-station tool arrangement where the individual tool stations are each provided with a load monitor device 138, as noted above in FIGS. 1–3, for communication of the loads at each tool station to the comparator 296 on line 298. An input reference load or desired load is provided to the comparator on line 300. In this case, the system may be selectively connected to the station to be monitored through a selector switch 299, and thereafter a control signal is provided on output line 302 to variable regulator means 274 for control of the fluid pressure to the cylinders 279 of the bolster 18*a*. This control of the fluid pressure to the bolster pistons and cylinders will thus vary the shutheight to control the force at the various tool stations as described previously.

Figure 16:
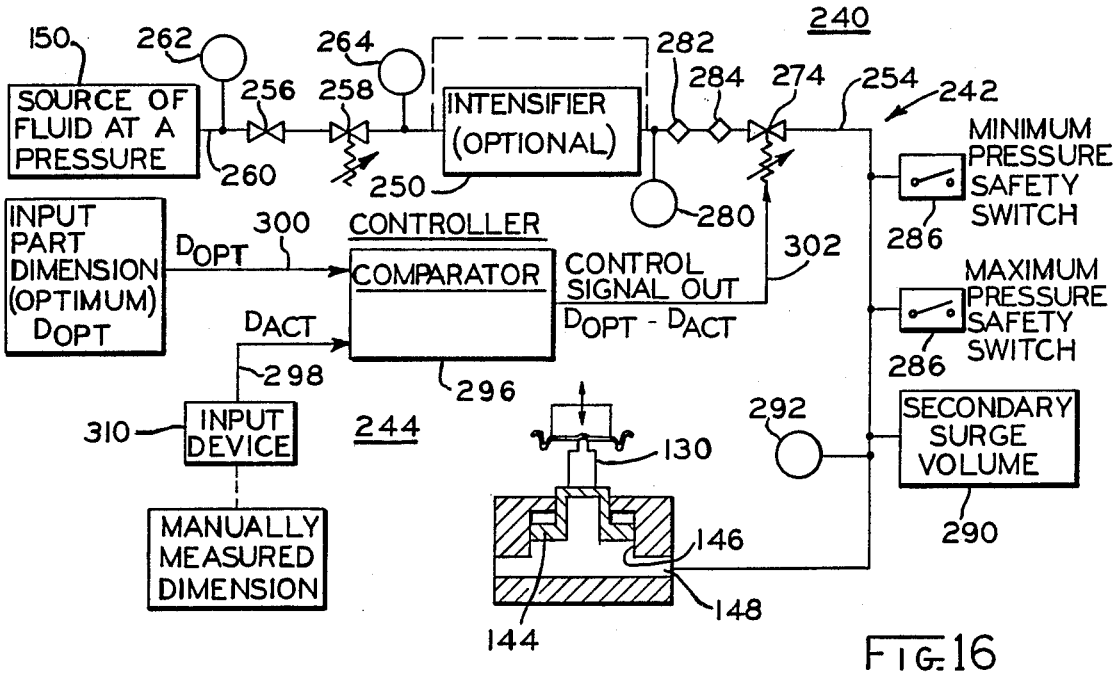
FIGS. 16–19 are alternative embodiments of control circuit arrangements for individual tool stations; and, FIG. 20 is an exemplary diagrammatic arrangement of an automatic dimensional monitor system.

FIG. 16 illustrates the use of the above-described manually measured arrangement in FIG. 13 to control a single station tool arrangement on a press. In this configuration, a manually measured dimension is again provided to comparator 296 through input device 310 and line 298 for comparison with a desired or reference dimension provided on line 300 to comparator 296. For example, the operator could periodically measure a particular part dimension with a micrometer and then enter this dimension into the comparator 296 by means of a keyboard or dial 310. Based on the difference, for example, between the reference and measured signals, comparator 296 provides a control signal on line 302 to regulator means 274 for control of the fluid pressure to the back-up load means to control the force at tool 130 for forming the formed piece without use of a load sensor 138.

Figure 17:
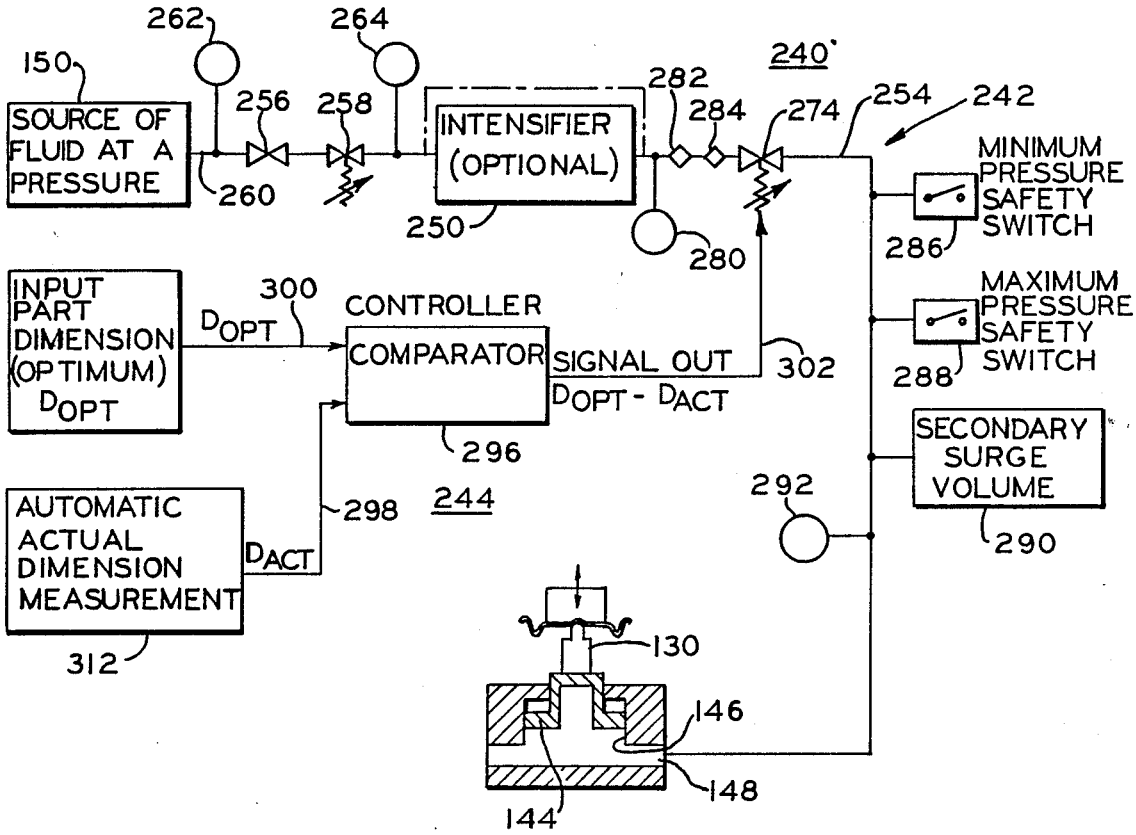

FIG. 17 shows an alternative embodiment of the control circuit 240 and a single tool station wherein a dimension of a part formed by tool 130 is automatically measured by device 312, such as the video inspection device of FIG. 20, and a signal is provided on line 298 to comparator 296 indicative of the actual dimension. A desired input or part dimension is communicated to controller 296 over line 300 and may be compared to the actual dimension signal by controller 296. Based on the comparison a control signal output on line 302 is communicated to regulator means 274 to control the fluid pressure to the fluid-backed tool, which controls the back-up force operable on tool 130 to maintain the desired finished part dimension.

Figure 18:
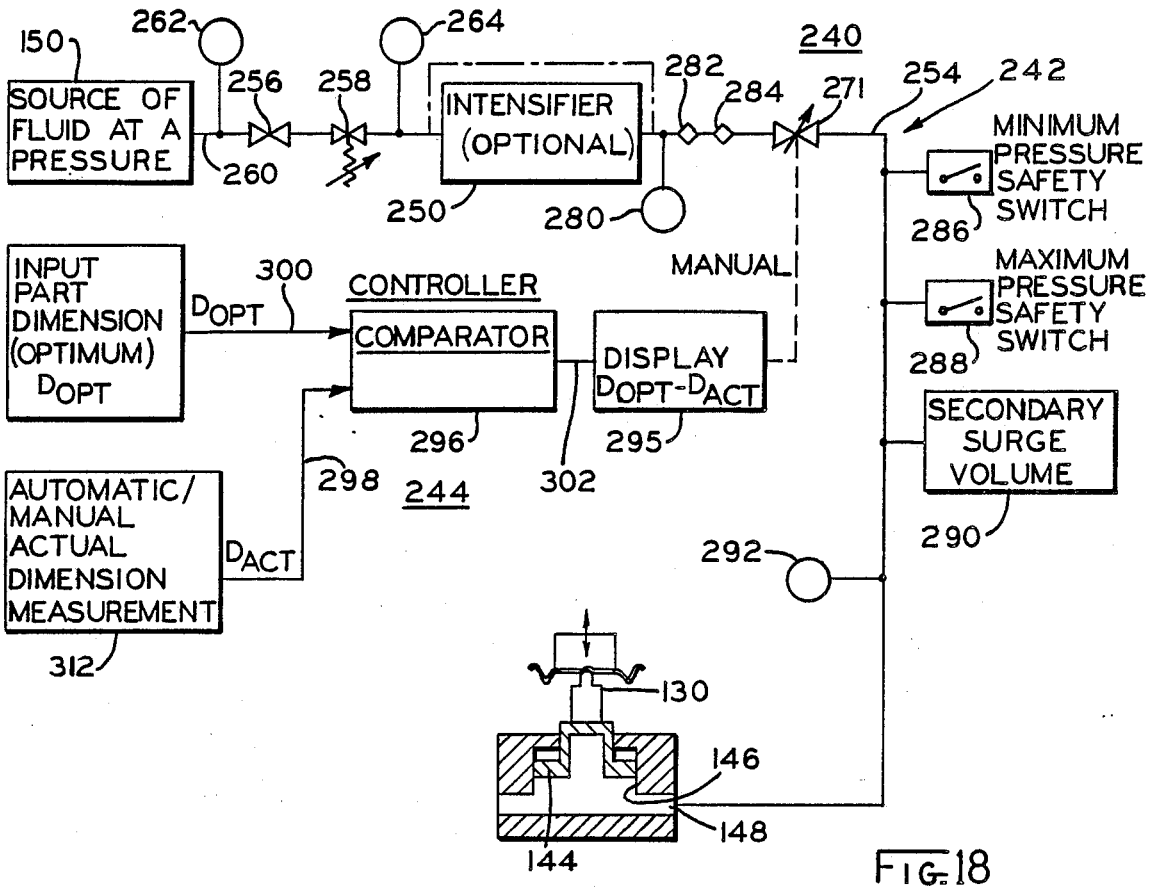

FIG. 18 illustrates the use of an automatic part dimension measurement device 312, such as the video inspection device in FIG. 20, to provide an actual dimension signal on line 298 to controller 296 for comparison to a desired input part dimension provided on line 300 to controller 296. Controller 296 then provides a display output or signal on display device 295, which displayed signal is indicative of the difference between these input signals. Manually operated regulator means 271 is illustrated as a manually operated regulator valve in line 254 to control the fluid pressure to a selected one of the fluid-backed tools 130 for independent adjustment of the back-up force on the formed piece and thus the finished dimension part. In FIG. 18, it is evident that a manually determined dimensional measurement may be provided to controller 296, which measurement is utilized in determining the display signal provided on display device 295. Thereafter regulator means 271 is manually operable to control the pressure in line 254 based on the displayed signal.

Figure 19:
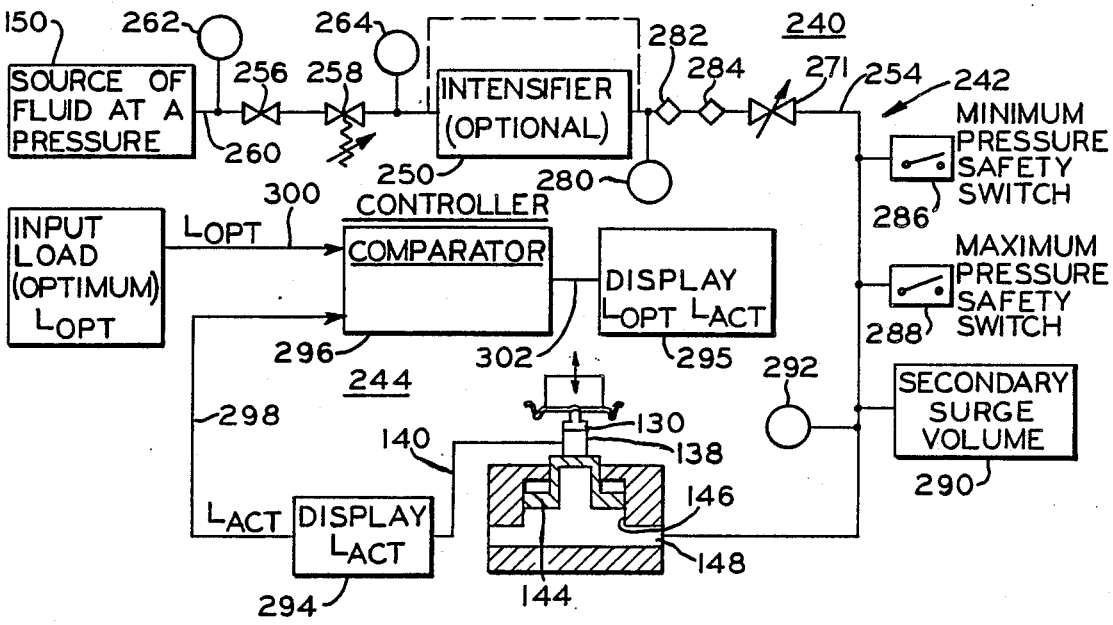

FIG. 19 illustrates another embodiment of the control system wherein the load at tool 130 is automatically sensed by load cell 138 and communicated to controller 296 through display 294 over lines 140 and 298. Controller 296 can receive an input load signal on line 300, which is indicative of a desired or optimal load. The controller 296, as noted above, could be a comparator for comparison of the actual load signal to the desired load signal and provide an output error control signal on line 302 to a display device 295 similar to the calibrated signal device. The back-up load acting on tool 130 can be continuously monitored and manually varied by a manually operable valve 275 during press operation, if desired.

While only certain embodiments of the invention have been described and claimed herein, it is apparent that various modifications and alterations of the invention may be made. It is therefore the intention in the appended claims to cover all such modifications and alterations as may fall within the true spirit and scope of the invention.

What is claimed is:

1. In a press having a tool means, a control system for continuous tool load adjustment comprising:

fluid pressure operated back-up load means for providing a variable back-up load to said tool means;

sensing means for sensing the load at said tool means and generating a single sensed back-up load signal indicative of said tool means load;

controller means for receiving an input reference signal and said sensed back-up load signals and providing an output control signal as a function only of said input signals;

a source of fluid at a pressure coupled to said back-up load means; and a variable fluid pressure circuit means connected to said controller means and coupled between said source of fluid at a pressure and thereby said back-up load means for varying dynamically the back-up load to said tool means as a function only of said controller means output signal.

2. A control system for continuous tool load adjustment as claimed in claim 1 further comprising a calibrated signal display coupled between said sensing means and said controller means.

3. A control system for continuous tool load adjustment as claimed in claim 2 wherein said signal display is calibrated as a function of said sensed tool means load.

4. A control system for continuous tool load adjustment as claimed in claim 1 wherein said sensing means is a load cell.

5. A control system for continuous tool load adjustment as claimed in claim 4 wherein said tool means includes an upper tool means and a lower tool means, said upper and lower tool means cooperating to form a part, and said load cell is mounted in one of said upper and lower tool means and operable to sense the tool load thereon.

6. A control system for continuous tool load adjustment as claimed in claim 1 wherein said back-up load means includes a cylinder and a piston operable in said cylinder, said piston operable by said fluid at a pressure to maintain said back-up load.

7. A control system for continuous tool load adjustment as claimed in claim 6 wherein said sensing means includes a load cell positioned between said piston and said tool means.

8. A control system for continuous tool load adjustment as claimed in claim 1 wherein: said tool means includes an upper tool means and a lower tool means for forming a part, said back-up load means comprises a constant load device mounted to and operable with one of said upper and lower tool means, said variable fluid pressure control circuit means includes a conduit connected between said constant load device and said source of fluid to communicate said fluid therebetween, said fluid pressure circuit means comprising a variable regulator means for varying said fluid pressure mounted in said conduit downstream of said source of fluid, at least one surge volume coupled to said conduit, said sensing means is a load cell mounted and operable between said constant load device and said one of upper and lower tool means, which load cell is operable to sense the load on said one tool means and communicate a signal to said controller means, said controller means operable to provide an output control signal to said variable regulator means, said regulator means is operable to control said fluid pressure to said constant load device to maintain a desired tool load as a function of said output control signal.

9. A tool arrangement for a press having a slide and a bolster assembly comprising:

an upper tool assembly including an upper tool mounted on an operable with said slide;

a lower tool assembly with a lower tool mounted on said bolster assembly;

a constant load piston and cylinder means mounted to and operable with one of said upper and lower tool assemblies, said piston and cylinder means operable to provide a back-up load to said one tool;

a load sensor means for sensing a tool load and providing a single output signal, said sensor means being mounted and operable in one of said upper and lower tool assemblies;

a source of fluid at a pressure communicating with said constant load piston and cylinder means to provide a back-up load to said piston and cylinder means and said one tool; and a controller means for receiving said output signal from said load sensor means and a reference signal and providing an output signal that is a function of the comparison only of said load sensor output signal and said reference signal, said controller means being coupled between said source of fluid at a pressure and said piston and cylinder means to control dynamically said fluid pressure to said piston and cylinder means in accordance with the value of the controller output signal.

10. A tool arrangement for a press as claimed in claim 9 wherein said controller means comprises a variable, controllable regulator means for controlling fluid pressure, said regulator means receives an output signal from said controller means and is responsive to said output signal to vary the fluid pressure and back-up load to said piston and cylinder means.

11. A control system for continuous tool and load adjustment for a press assembly having a frame, an upper tool mounting apparatus with an upper tool secured thereto, and a lower tool mounting apparatus with a lower tool secured thereto, said control circuit comprising:

a sensing means for sensing a tool load, said sensing means being generally positioned and operable between one of said upper tool and upper tool mounting apparatus and lower tool and lower tool mounting apparatus, said sensing means producing a single output signal correlated to the sensed load;

a source of fluid at a pressure;

a fluid back-up load means for providing a back-up load to at least one of said tools;

a variable fluid pressure circuit operable between said source of fluid at a pressure and said back-up load means;

at least one variable regulating means for controlling fluid pressure, which regulating means is mounted and operable in said fluid circuit; and a controller means for receiving said output signal from said sensing means indicative of said sensed tool load and providing a control signal to said regulating means as a function only of the variation of said ouput signal to control dynamically the back-up load to said one tool.

12. A control system for continuous tool and tool load adjustment as claimed in claim 11 wherein:

said back-up load means includes a constant load device;

said variable fluid pressure circuit includes a conduit connected and communicating fluid between said source of fluid at a pressure and said constant load device;

said regulating means being operable in said conduit downstream of said source of fluid at a pressure;

said sensing means comprises at least one pressure monitoring means for measuring fluid pressure mounted in said conduit, which pressure monitoring means is coupled to said controller and operable to provide a pressure signal indicative of the back-up load at said one tool to said controller means;

said controller means operable to provide an output signal to control said variable regulating means to control said fluid pressure to said constant load device to maintain a desired tool load.

13. In a press having tooling comprising a first reciprocating tool means and a second tool means, a control system for continuous tool back-up load adjustment comprising:

back-up load means associated with one of said tool means for providing a controllable back-up load to said one tool means, sensing means for sensing the load on said tooling when said first and second tool means engage a workpiece therebetween and generating a single sensed back-up load signal indicative only of said tooling load, and controller means connected to said back-up load means and said sensing means for receiving said sensed load signal and a reference signal indicative of the desired tooling load and dynamically varying the back-up load produced by said back-up load means in response only to said sensed and reference signals to achieve the desired tooling load.

14. The press of claim 13 wherein said sensing means comprises a force sensor on said tooling and said controller means comprises a comparator means for comparing said sensed and reference signals and producing a control signal relating to the difference between said sensed and reference signals and transmitting the control signal to said back-up load means.

15. The press of claim 13 wherein said controller means produces an output control signal for varying the back-up load, said back-up load means comprises a piston and cylinder connected to said one tool means and a variable fluid pressure supply means connected to said piston and cylinder, said supply means having a control input connected to said controller means output signal.

16. The press of claim 15 wherein said fluid pressure supply means includes a surge volume and a variable fluid regulator connected to said controller means output signal.

17. The press of claim 15 wherein said back-up load means maintains a constant fluid pressure in said piston and cylinder once that pressure is set by said controller means.

18. The press of claim 13 wherein said controller means produces an output control signal for varying the back-up load, said back-up load means comprises a piston and cylinder connected to said one tool means and a variable fluid pressure supply means connected to said piston and cylinder, said supply means having a control input connected to said controller means output signal and wherein said sensing means comprises means for sensing the fluid pressure in said piston and cylinder.

19. The press of claim 13 wherein said tooling comprises a plurality of individual tool stations each comprising a said first reciprocating tool means and a second tool means, and comprising individual said back-up load means and individual said sensing means for each of said tool stations, and said controller means independently controls the back-up load means at each said tool station in response to reference signals and in response to the sensed signals from respective said sensing means.

20. The press of claim 13 wherein said first and second tool means cooperate to define a shutheight therebetween, which first and second tool means include a plurality of tool stations; said back-up load means comprises means for varying the shutheight between all of said tool stations.

21. In a press having a reciprocating slide and a bolster and tooling comprising a plurality of die stations, each of said die stations having a first tool means connected to said slide and a second tool means connected to said bolster, said die stations adapted for performing respective forming operations on a workpiece moving through said press, and means for moving the workpiece sequentially through said plurality of die stations, a control system for continuous tool back-up load adjustment comprising:

a plurality of individual back-up load means associated respectively with said die stations for producing a variable controllable back-up load to the tool means in said die stations, a plurality of sensing means at respective said die stations for sensing the load on said tool means in the station when said first and second tool means engage a workpiece therebetween and generating a single sensed back-up load signal indicative of the tool means loading at each die station, and controller means having inputs connected to each of said sensing means for receiving the sensed load signal therefrom and having means for receiving reference signals indicative of desired loads at the respective die stations and means for independently varying the back-up loads produced by said plurality of back-up load means in response only to the sensed and reference signals to achieve desired loads at each of said die stations.

22. The press of claim 21 wherein said sensing means each comprises a force sensor connected to one of said tool means in the respective die station.

23. The press of claim 21 wherein: said back-up means each comprises a piston and cylinder and a variable pressure fluid supply means for supplying fluid under pressure to the piston and cylinder, said fluid supply means are each controlled by said controller means to vary the back-up load on the respective die station tool means.

24. The press of claim 23 wherein each of said sensing means comprises means for sensing the fluid pressure at the respective said piston and cylinder.

25. In a press having tooling comprising reciprocating first and second tool means for performing forming or shearing operations on a workpiece passing through the press, a control system for continuous tool back-up load adjustment comprising:

back-up load means associated with one of said tool means for producing a variable controllable back-up load to said one tool means, workpiece quality parameter sensing means for sensing a predetermined parameter of the workpiece formed by said tooling that varies depending upon the amount of force exerted on the workpiece by the tooling and producing a single sensed back-up load signal indicative of the force exerted on the workpiece that correlates to the value of said parameter that is sensed, and controller means connected to said back-up load means and to said parameter sensing means for receiving the back-up load signal therefrom and receiving a reference signal indicative of a back-up load that correlates to a desired value of said parameter and varying the back-up load produced by said back-up load means while the press is running in response only to said sensed and reference signals to achieve the desired tooling load and, therefore, the desired parameter value.

26. The press of claim 25 wherein said sensing means measures a dimension of a portion of the workpiece that is formed by said tooling.

27. The press of claim 25 wherein said controller means produces an output control signal for varying the back-up load, said back-up load means comprises a piston and cylinder connected to said one tool means and a variable fluid pressure supply means connected to said piston and cylinder, said supply means having a control input connected to said controller means output signal.

28. The press of claim 25 wherein said tooling comprises a plurality of individual tool stations each comprising a first tool and a second tool and comprising individual said back-up load means at respective said tool stations, and wherein said sensing means comprises means for sensing a plurality of predetermined parameters of the workpiece that vary depending on the amount of force exerted on the workpiece at the respective tool stations and producing a plurality of back-up load signals indicative of the forces exerted on the workpiece that correlate to the values of the respective parameters that are sensed, said controller means is responsive to said back-up load signals and independently controls the back-up load means at each said die station in response to reference signals and in response to the signals received from said plurality of sensing means.

29. In a press having tooling comprising at least one set of reciprocating first and second tools for performing a forming operation on a workpiece passing through the press, a control system for continuous tool back-up load adjustment comprising:

back-up load means associated with said tool means for producing a variable controllable back-up load to said tool means, workpiece quality parameter sensing means for sensing a predetermined dimensional parameter of the workpiece formed by said tooling, which parameter varies depending upon the amount of force exerted on the workpiece by the tooling, and producing a single sensed back-up load signal indicative of the force exerted on the workpiece that correlates to the value of said parameter that is sensed, and controller means connected to said back-up load means and to said parameter sensing means for receiving the back-up load signal therefrom and for receiving a reference signal indicative of a back-up load that correlates to a desired value of said parameter, and said controller means varying the back-up load produced by said back-up load means while the press is running in response only to said sensed and reference signals to achieve the desired tooling load and, therefore, the desired said parameter value.

30. The press of claim 29 wherein said controller means produces an output control signal for varying the back-up load, said first and second tools defining a shutheight therebetween, said back-up load means comprising a fluid-backed bolster and a variable fluid pressure supply means connected to said bolster; said fluid supply means having a fluid control input means connected to said controller means output signal for elastically deforming said bolster to vary said shutheight.

* * * * *